US006644187B2

(12) United States Patent
Okamoto et al.

(10) Patent No.: US 6,644,187 B2
(45) Date of Patent: Nov. 11, 2003

(54) PRINTER AND SHEET CONVEYING DEVICE THEREFOR

(75) Inventors: Toyoo Okamoto, Miyagi (JP); Yoshihiko Kudoh, Miyagi (JP); Akira Saito, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/827,234

(22) Filed: Apr. 6, 2001

(65) Prior Publication Data

US 2001/0051063 A1 Dec. 13, 2001

(30) Foreign Application Priority Data

| | | |
|---|---|---|
| Apr. 28, 2000 | (JP) | 2000-129909 |
| Apr. 28, 2000 | (JP) | 2000-130110 |
| Jun. 2, 2000 | (JP) | 2000-165897 |
| Jun. 2, 2000 | (JP) | 2000-165975 |
| Jun. 9, 2000 | (JP) | 2000-173412 |
| Jun. 9, 2000 | (JP) | 2000-173415 |
| Dec. 28, 2000 | (JP) | 2000-401533 |

(51) Int. Cl.[7] ..... B65H 5/10; B65H 5/08; B65H 5/02

(52) U.S. Cl. ..... 101/232; 101/216; 271/10.1; 271/3.24

(58) Field of Search ..... 101/135, 214, 101/215, 146, 186, 189, 250, 251, 279, 216, 217, 232; 271/4.06, 4.09, 7, 12, 10.07, 10.1, 10.15, 3.24

(56) References Cited

U.S. PATENT DOCUMENTS

| | | | | | |
|---|---|---|---|---|---|
| 3,664,261 | A | * | 5/1972 | Dahlgren | 101/177 |
| 4,796,556 | A | * | 1/1989 | Bird | 101/177 |
| 5,265,535 | A | * | 11/1993 | Isowa et al. | 101/148 |
| 5,477,780 | A | * | 12/1995 | Keller | 101/137 |
| 6,340,554 | B1 | * | 1/2002 | Kawamura et al. | 430/270.1 |
| 2002/0060410 | A1 | * | 5/2002 | Uera et al. | 271/204 |

FOREIGN PATENT DOCUMENTS

| | | | | | |
|---|---|---|---|---|---|
| DE | 4344260 | A1 | * | 6/1995 | B41L/17/08 |
| GB | 2314834 | A | * | 1/1938 | B41F/21/08 |
| GB | 2277903 | A | * | 11/1994 | B41F/21/08 |
| JP | 60044349 | A | * | 3/1985 | B41F/21/08 |
| JP | 8-7402 | | | 3/1996 | |
| JP | 2618535 | | | 3/1997 | |
| JP | 09-141821 | | | 6/1997 | |
| JP | 2695117 | | | 9/1997 | |
| JP | 2983661 | | | 9/1999 | |
| JP | 11-334037 | | | 12/1999 | |
| JP | 2000-000957 | | | 1/2000 | |
| JP | 2000-044859 | | | 2/2000 | |
| JP | 2000-127333 | | | 5/2000 | |
| JP | 2000-127335 | | | 5/2000 | |
| JP | 2000-127336 | | | 5/2000 | |
| JP | 2000-141595 | | | 5/2000 | |

OTHER PUBLICATIONS

Stencil definition, The American Heritage Dictionary of the English Language, Third Edition, 1992, Houghton Mifflin Co.*

Lithography definition, The American Heritage Dictionary of the English Language, Third Edition, 1992, Houghton Mifflin Co.*

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

A printer of the present invention includes a chain-delivery type of sheet conveying device arranged in an image transfer region that adjoins image transfer drums. The sheet conveying device includes a pair of drive pulleys, a pair of driven pulleys, a pair of chains each being passed over one drive pulley and one driven pulley, and a clamper affixed to the chains at opposite ends thereof. Each chain has a circumferential length that is an integral multiple of the circumference of an image transfer drum, and a number of teeth that is an integral multiple of the number of teeth of the drive pulley. A stabilizing mechanism is positioned in the image transfer region for preventing the chains from shaking.

87 Claims, 28 Drawing Sheets

PRINTER AND SHEET CONVEYING DEVICE THEREFOR

BACKGROUND OF THE INVENTION

The present invention relates to an offset printer or similar printer using a master.

It is a common practice with an offset printer or similar printer to use a chain-delivery type of conveying system for conveying a paper sheet or similar recording sheet. The chain-delivery type of conveying system includes a pair of parallel, toothed belts or similar chains and a clamper affixed to the chains at opposite ends thereof. The clamper clamps the leading edge of a paper sheet and conveys it in accordance with the movement of the chains.

Generally, a chain delivery type of conveying system is constructed to receive a paper sheet carrying an image thereon, i.e., a print and coveys it to a sheet discharge position, as taught in Japanese Patent Laid-Open Publication No. 11-334037 by way of example. The conveying system includes a clamper constantly biased by a spring such that the clamper tends to close. At a sheet receipt position, a cam causes the clamper to open for receiving a paper sheet and then close to clamp the paper sheet. Likewise, at a sheet discharge position, a cam causes the clamper to open for releasing the paper sheet and then close.

In a printer including a plurality of print drums, one press drum is assigned to each print drum and has substantially the same diameter as the print drum. A clamper is mounted on the press drum for clamping a paper sheet. After a paper sheet has been wrapped around the press drum, the press drum is pressed against the print drum. This type of conveying system is generally referred to as a press drum relay system.

Japanese Patent No. 2,983,661, for example, discloses a multicolor stencil printer applying the chain-delivery type of conveying system to an image transfer region. Specifically, the printer includes chains running from the upstream side to the downstream side in an image transfer positions a plurality of print drums assigned to different colors are positioned. A clamper is affixed to the chains. While the clamper clamps a paper sheet and conveys it in accordance with the movement of the chains, press rollers each press the paper sheet against associated one of the print drums. As a result, images of different colors are sequentially transferred to the paper sheet one above the other. A recess is formed in each press roller so as not interfere with a clamper mounted on the print drum or the clamper affixed to the chains. Each press roller is identical in diameter with the print drum.

A copier or similar image forming apparatus of the type using toner for forming an image on a paper sheet is also conventional. This type of image forming apparatus may include a single photoconductive element or similar image carrier and a plurality of developing devices arranged around the image carrier. The image forming apparatus is capable of printing multicolor images, including a full-color image, on paper sheets. On the other hand, an offset printer, for example, prints a multicolor image with, e.g., a plurality of print drums or similar image carriers corresponding in number to colors to be used.

An offset printer, for example, uses viscous ink and must therefore transfer the ink to a paper sheet with a high pressure. It follows that a developing device needs a number of rollers greater in diameter than rollers included in, e.g., a copier and need far higher rotation speed and torque than general office equipment. The developing device is therefore so bulky, arranging a plurality of developing devices around a single print drum has heretofore been impractical.

The present invention addresses to the following problems (1) through (6).

(1) Assume that the chain-delivery type of system is applied to an image transfer region. Then, it is difficult to define image transfer timings to a plurality of image carriers as accurately as with the press drum relay type of system. Consecutive image transfer positions are therefore apt to shift, causing resulting images to shift. Further, the chains involve a play for movement and necessarily shake during movement. The shake of the chains, however, causes a paper sheet to reach an image transfer position assigned to an image carrier while fluttering. This is apt to cause an image to blur on the paper sheet. For these reasons, the press-drum relay type of system is still predominant over the chain-delivery type of system. However, the chain-delivery type of system is advantageous over the press drum relay type of system in that it does not hand over a paper sheet and promotes highly accurate image transfer free from irregular registration.

(2) The clamper affixed to the chains is constantly biased in which it tends to close, and caused to open and close at a preselected position by a cam, as stated earlier. However, because the clamper opens and closes against a biasing force, reaction occurs during opening and closing movements. The reaction causes the chains to shake and thereby makes the receipt of a paper sheet unstable. Unstable receipt of a paper sheet directly translates into damage to the clamped portion of a paper sheet and the shift of a clamping position. When the chain-delivery type of system is applied to an image transfer region, a clamping position other than preselected one results in an image position shifted from expected one. Further, at a releasing position, the clamper is simply opened to release a paper sheet. The paper sheet is therefore apt to adhere to the clamper due to a clamping force maintained during conveyance. This is likely to prevent the clamper from releasing the paper sheet at the preselected releasing position, resulting in defective sheet discharge or a sheet jam.

(3) The press drum relay type of system is predominant over the chain-delivery type of system, as stated above. Even the chain-delivery type of system taught in Japanese Patent No. 2,983,661 and applied to an image transfer region reflects the concept of the press drum relay type of system. Specifically, a press roller having substantially the same diameter as a print drum presses a paper sheet against the print drum. The printer is therefore bulky and cannot make the most of the merits of the chain-delivery type of system.

(4) In a printer, a paper sheet is apt to adhere to a print drum due to the viscosity of ink. It is therefore likely that a paper sheet is not separated from the print drum, but rolls up in accordance with the rotation of the print drum. In the chain-delivery type of system, the clamper clamps the leading edge of a paper sheet and continuously clamps it even at a nip for image transfer, so that a separating force naturally acts on the paper sheet. However, at the position between the clamper and the nip for image transfer, the paper sheet is not fully tense, but slightly bends and slightly rolls up, as will be discussed more specifically later.

(5) Generally, in an offset printer or similar printer, an image carrier and the other arrangements must be released from each other in a preparatory step before printing, e.g., a step of depositing ink on a master wrapped around the image carrier. Although this kind of scheme is essential even with a printer of the type having a sheet conveying device arranged at one side of an image forming unit, such a construction has not been reported yet.

(6) Waterless offset printing and DI (Digital Imaging) are recent achievements in the imaging art. However, a compact design with a plurality of developing devices arranged around a single image carrier has not been realized for an offset printer or similar printer.

Technologies relating to the present invention are also disclosed in, e.g., Japanese Patent Laid-Open Publication Nos. 9-141821, 2000-957, 2000-127333, 2000-127335, 2000-127336, 2000-141595 and 2000-44859, Japanese Patent Nos. 2,618,535 and 2,695,117 and Japanese Utility Model Publication No. 8-7402.

SUMMARY OF THE INVENTION

It is therefore an object of the present invention to provide a printer capable of performing highly accurate image transfer by solving the problems of the chain-delivery type of sheet conveying system while making the most of its merits.

It is another object of the present invention to provide a sheet conveying device capable of freeing a paper sheet from damage and the shift of an image position by obviating the shake of chains at the time of clamping, and surely releasing a paper sheet at a discharge position, and a printer including the same.

It is another object of the present invention to provide a miniature printer making the most of the merits of the chain-delivery type of sheet conveying system.

It is still another object of the present invention to provide an offset printer, stencil printer or similar printer capable of separating a paper sheet from a print drum or image carrier in a constant condition and thereby enhancing image quality.

It is yet another object of the present invention to provide a printer having a sheet conveying device arranged at one side of an image forming unit and mechanisms for releasing an image carrier and the other arrangements.

It is a further object of the present invention to provide a printer including a plurality of developing devices arranged around a single image carrier.

In accordance with the present invention, a printer includes at least one image carrier, and a sheet conveying device for conveying a sheet to which an image is to be transferred from the image carrier. The sheet conveying device includes a chain driven to run through an image transfer region, which is positioned immediately below the image carrier, from an upstream side to a downstream side in the direction of sheet conveyance, and a clamper affixed to the chain for clamping the sheet fed at a sheet feed position, which is located at the upstream side of the image transfer region.

Also, in accordance with the present invention, a sheet conveying device includes a chain driven to turn, a clamper affixed to the chain and constantly biased to remain in a closed position for clamping a sheet, and a cam device for sheet feed for causing the clamper to open, clamp the sheet, and then close. The cam device includes a cam for causing the clamper to open and then close, a guide member for preventing the chain from shaking when the clamper opens and closes.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 31:
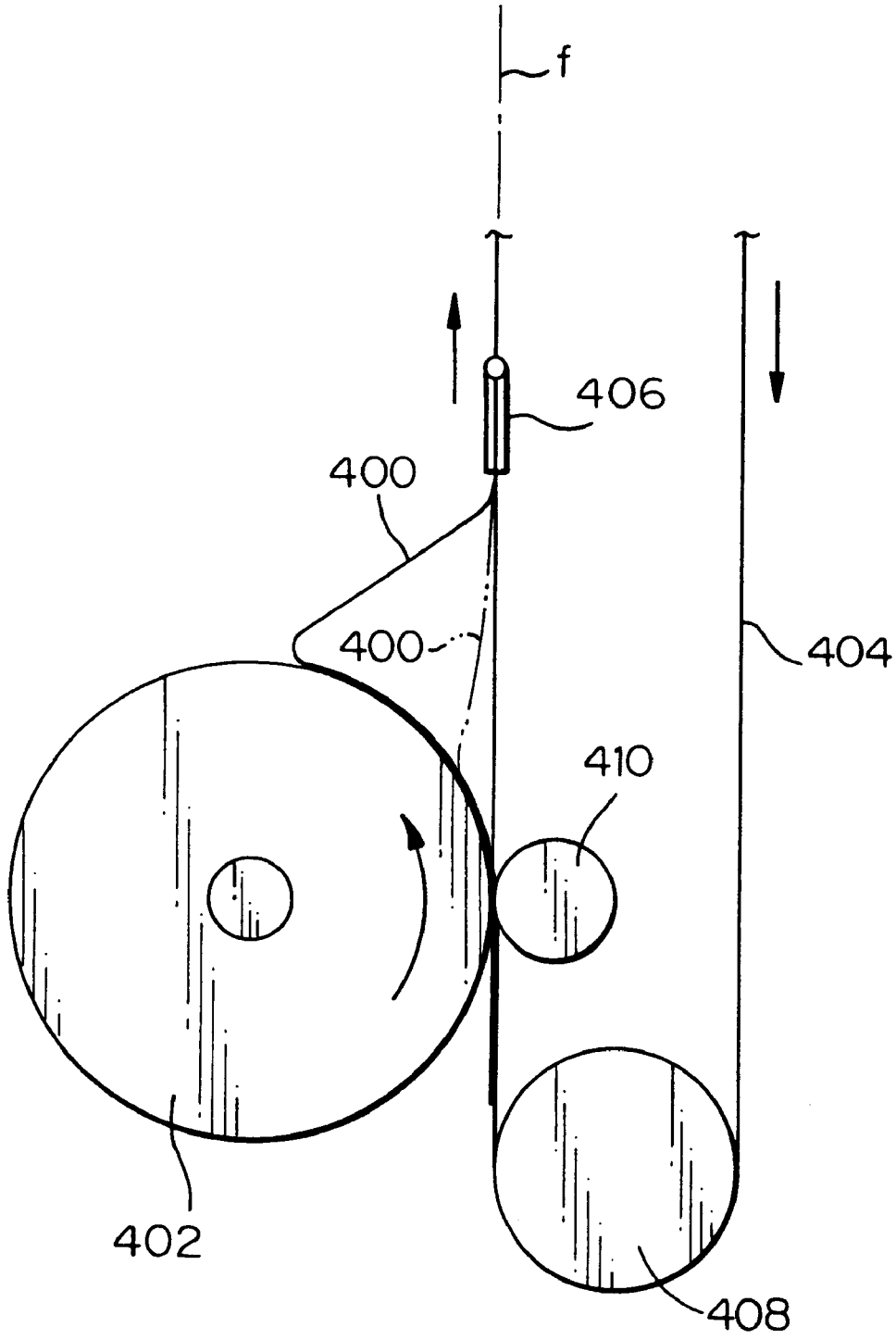
FIG. 31 is a front view showing how a paper sheet rolls up in a conventional printer.

To better understand the present invention, brief reference will be made to a conventional chain-delivery type of sheet conveying system, shown in FIG. 31. As shown, the system includes a chain 404 passed over a pulley 408 and a clamper 406. A print drum 402 and an image transfer roller 410 face each other with the intermediary of the chain 404, forming a nip for image transfer therebetween. The chain 404 conveys a paper sheet or similar recording sheet 400 with the clamper 406 clamping the leading edge of the paper sheet 400. The roll-up problem (4) stated earlier will be described more specifically hereinafter.

The clamper 406 keeps clamping the leading edge of the paper sheet 400 even at the nip for image transfer, so that a separating force naturally acts on the paper sheet 400. However, the paper sheet 400 is not fully tense between the clamper 406 and the nip, but slightly bends away from a conveyance plane f, as indicated by a dash-dots line in FIG. 31. Consequently, the paper sheet 400 slightly rolls up. Let the roll-up occurring at this stage be referred to as initial roll-up.

The paper sheet 400 is angled relative to the conveyance plane f due to the initial roll-up. Even in this condition, the clamper 406 would easily separate the paper sheet 400 from the print drum 402 if provided with a great clamping force. Such a clamping force, however, would leave a clamp mark on the paper sheet 400 and would thereby lower the quality of the resulting print.

When the paper sheet 400 is angled relative to the conveyance plane f due to the initial roll-up, the conveying force of the clamper 406 does not act on the paper sheet 400 as effectively as when the paper sheet 400 is straight. As a result, if the paper sheet 400 adheres to the print drum 402 with a force exceeding the clamping force of the clamper 406, then the clamping position shifts and aggravates the roll-up, as indicated by a solid line in FIG. 31. In the worst case, the clamper 406 fails to separate the paper sheet 400 from the print drum 402 and causes it to fully roll up on the print drum 402.

The roll-up problem discussed above is brought about even in a press drum type of sheet conveying system.

Although the paper sheet 400 with the initial roll up may be separated from the print drum 402, the degree of roll-up and therefore the separating angle (peeling angle) is not constant. This renders image density irregular in a solid image portion.

Figure 1:
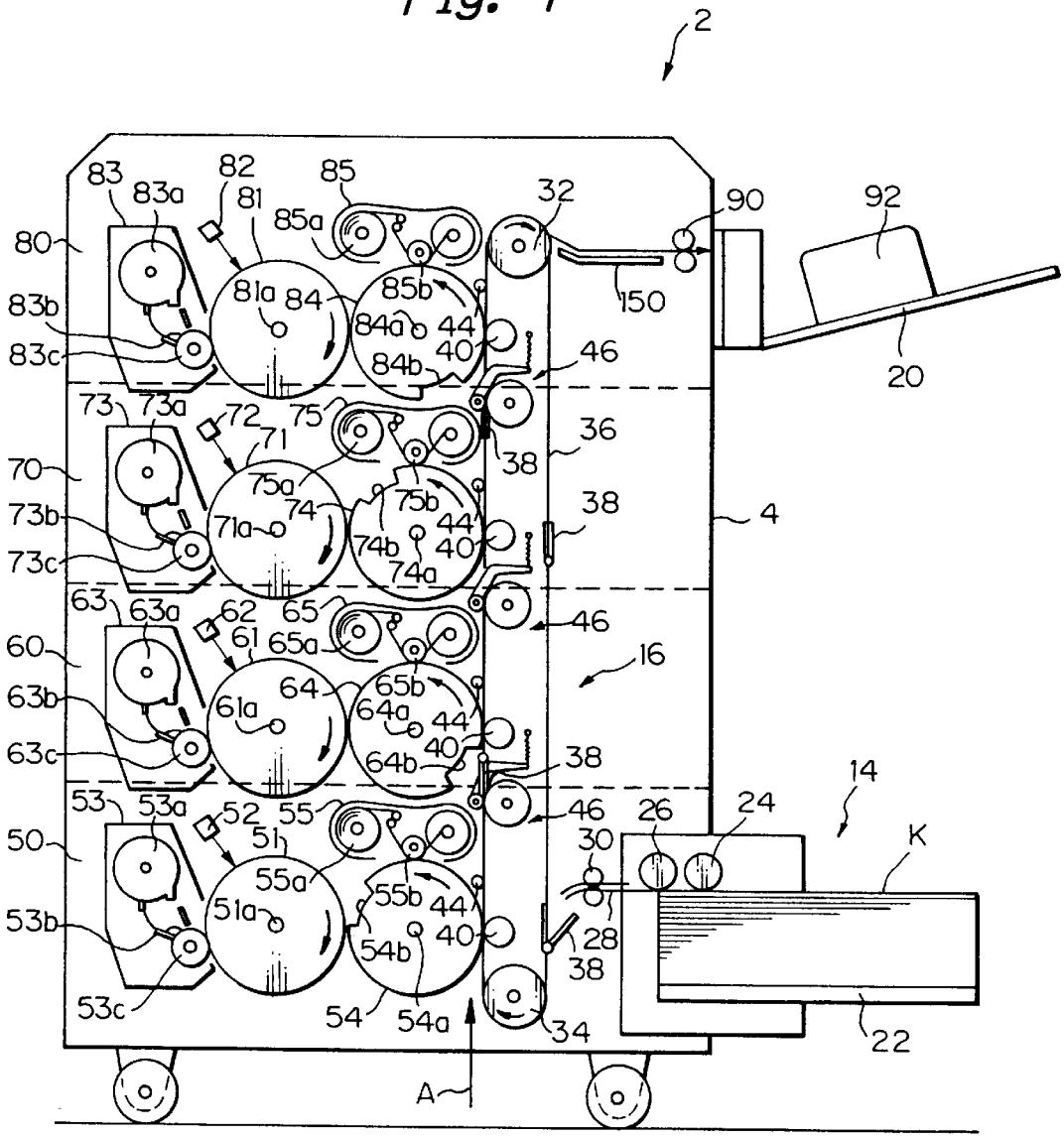
FIG. 1 is a front view showing the general construction of a printer embodying the present invention and implemented as an offset printer by way of example.

Referring to FIG. 1, a printer embodying the present invention is shown and implemented as an offset printer by way of example. As shown, the offset printer, generally 2, includes a frame 4. Four image forming sections 50, 60, 70 and 80 are arranged one above the other in substantially the vertical direction. A sheet conveying device 16 conveys a paper sheet or similar recording sheet K, which is paid out from a sheet feeder 14, via an image transfer region where the image forming sections 50 through 80 are arranged. The paper sheet K carrying an image thereon, i.e., a print is driven out of the frame 4 to a tray 20.

The image forming section 50 includes a master drum 51 mounted on a shaft 51*a*. A writing device 52 writes an image in a stencil (see FIG. 2) 300 or printing plate wrapped around the master drum 51. A developing device or ink feeding means 53 feeds ink to the master drum 51. An image transfer drum or intermediate image transfer body 54 faces the master drum 51. A cleaning device 55 cleans the surface of the image transfer drum 54 after image transfer.

The developing device 53 includes a removable ink bottle 53*a* storing cyan (C) ink, a doctor blade 53*b* for regulating the thickness of the ink, and a developing roller 53*c*. The image transfer drum 54 is mounted on a shaft 54*a* and formed with a recess 54*b* that does not interfere with the sheet conveying device 16. The cleaning device 55 includes a cleaning web 55*a* and a cleaning roller 55*b*.

The print drum 51, developing device 53 and image transfer drum 54 extend in substantially the horizontal direction.

Figure 2:
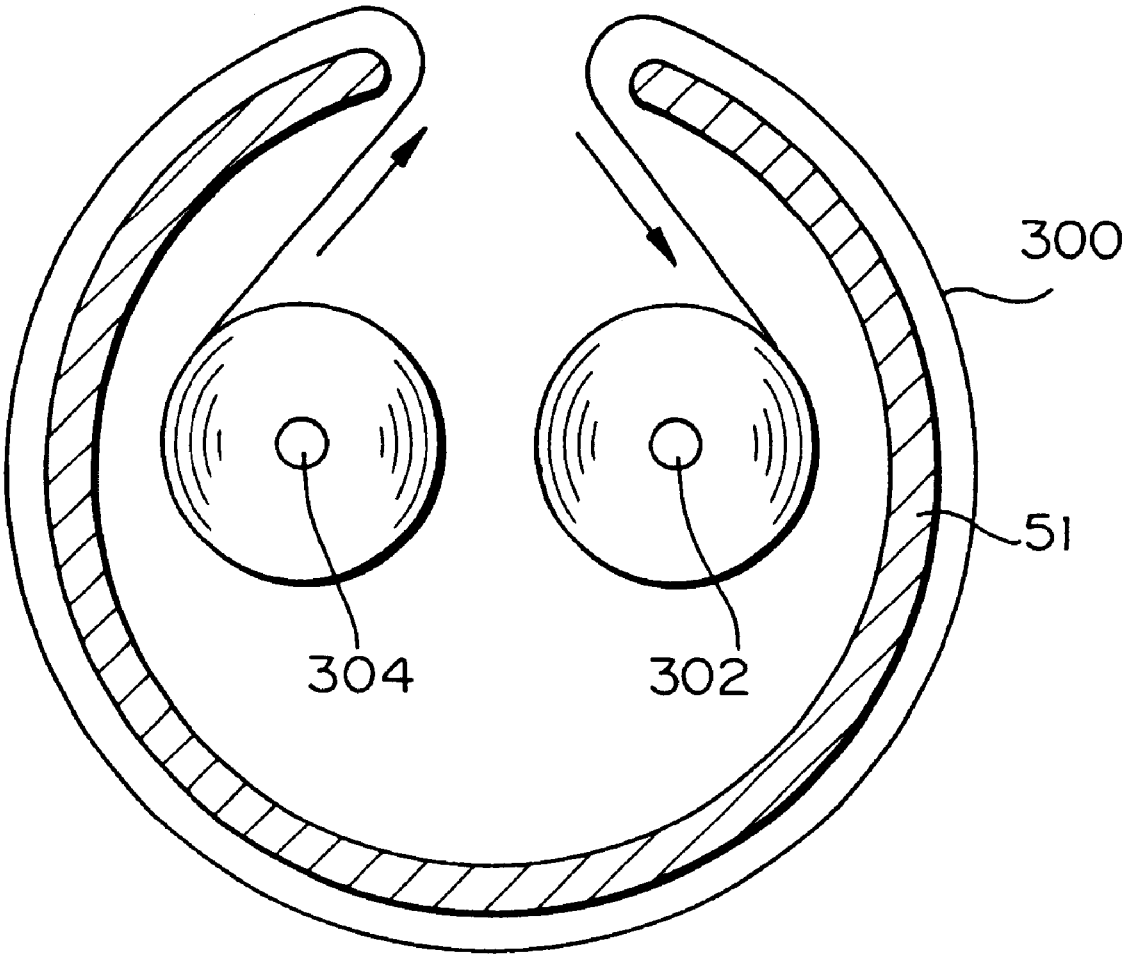
FIG. 2 is a sectional front view showing a stencil accommodated in and partly wrapped around an image carrier included in the illustrative embodiment.

As shown in FIG. 2, major part of the stencil 300 is received in the print drum 51. Also disposed in the print drum 51 are a take-up shaft 302 connected to a drive source, not shown, and a feed shaft 304. The take-up shaft 302 takes up the stencil 300 by being driven by the drive source, while causing the feed shaft 304 to rotate via the stencil 300. In this configuration, fresh part of the stencil 300 is wrapped around the master drum 51 at all times.

The stencil 300 is thermosensitive and water-repellant. Part of the stencil 300 heated looses water-repellency and becomes hydrophilic.

The image forming apparatuses 60, 70 and 80 are identical in configuration with the image forming apparatus 50 and will not be described specifically in order to avoid redundancy. Identical structural elements are designated by corresponding reference numerals throughout the image forming apparatuses 50 through 80. The difference is that an ink bottle 63*a* storing magenta (M) ink, an ink bottle 73*a* storing yellow (Y) ink and an ink bottle 83*a* storing black (Bk) ink are removably mounted to the image forming sections 60, 70 and 80, respectively.

The sheet feeder 14 includes a tray 22 loaded with a stack of paper sheets K. A pick-up roller 24 and a separator roller 226 cooperate to pay out the paper sheets K from the tray 22 one by one, the top sheet being first. A guide 28 guides the paper sheet K paid out from the tray 22 to a registration roller pair 30. The registration roller pair 30 stops the paper sheet K in order to correct, e.g., skew and then conveys it toward the conveying device 16 at a preselected timing.

The sheet conveying device 16 extends substantially vertically at one side of the image forming sections (image forming units) 50 through 80. The sheet conveying device 16 sequentially conveys the paper sheet K to image transfer positions between the image transfer drums 54, 64, 74 and 84 and associated image transfer rollers 40.

Figure 3:
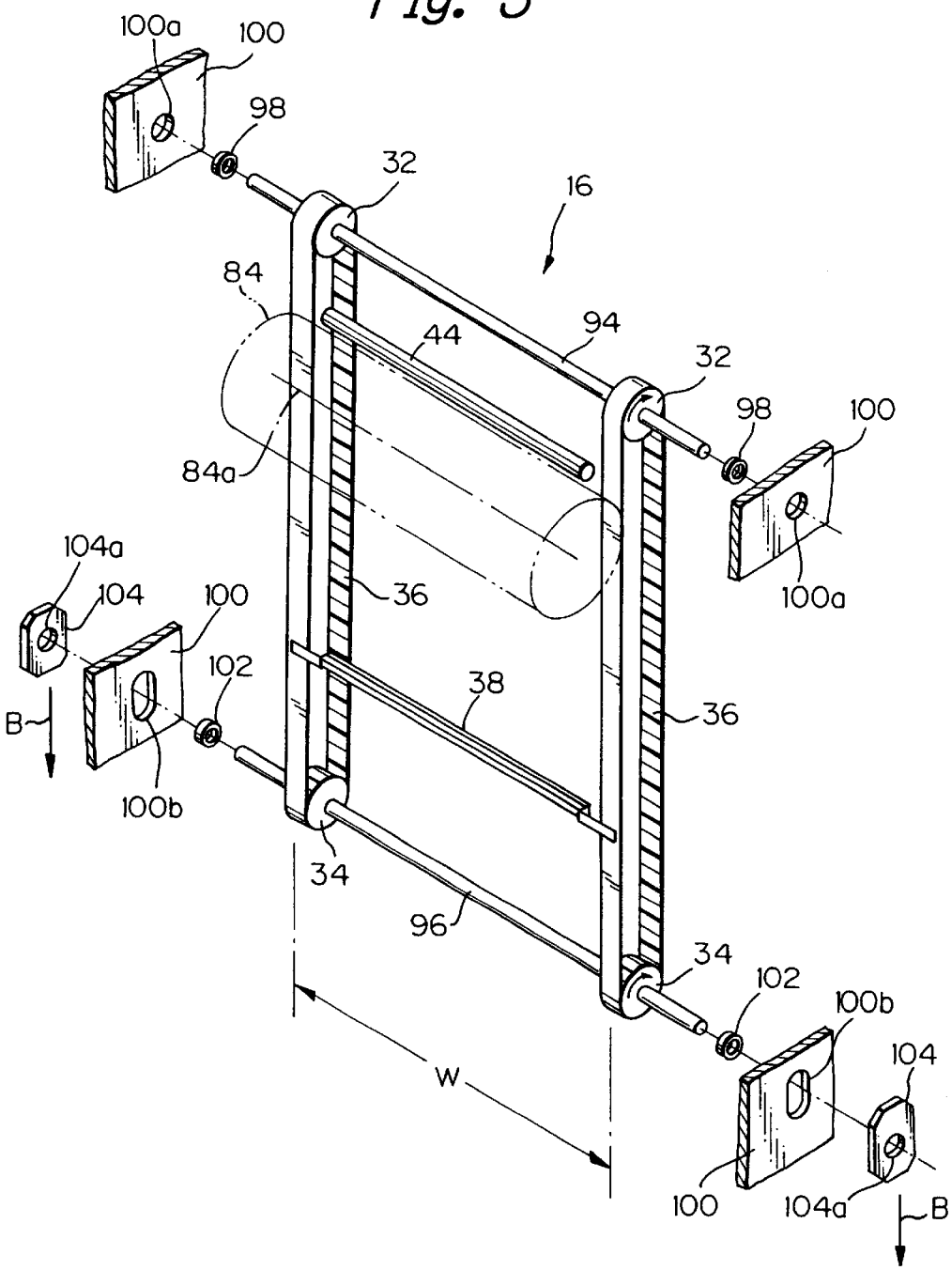
FIG. 3 is an isometric view sowing a sheet conveying device included in the illustrative embodiment.

As also shown in FIG. 3, the sheet conveying device 16 includes a pair of chains 36 passed over a pair of toothed drive pulleys 32 and a pair of toothed driven pulleys 34. The drive pulleys 32 and driven pulleys 34 are respectively positioned at the downstream side and upstream side with respect to a printing process, i.e., at the upper portion and lower portion of the conveying device 16. Four clampers 38 are affixed to the chains 36 at opposite ends thereof at preselected intervals. The chains 36 are driven to turn from the upstream side to the downstream side via the image transfer positions assigned to the image transfer drums 54, 64, 74 and 84.

Image transfer rollers or pressing means 40 each face one of the image transfer drums 54 through 84 with the intermediary of the chains 36 in order to press the paper sheet K against the associated image transfer drum. The image forming sections 50 through 80 each additionally include a pair of press rollers 42 and 44 for pressing the opposite sides of the paper sheet K.

Three stabilizing mechanisms 46 are arranged in the image transfer region at preselected intervals in a direction of paper conveyance, which is indicated by an arrow A. The stabilizing mechanisms 46 stabilize the movement of the chains 36.

In operation, when the operator presses a start switch positioned on an operation panel, not shown, a scanner, not shown, reads a document image and outputs an image signal representative of the document image. The writing device 52 writes an image in the stencil 300 wrapped around the master drum 51 in accordance with the image signal. At the same time, in the developing device 53, ink feeding means, not shown, feeds the cyan ink from the ink bottle 53*a* to a gap between the doctor blade 53*b* and the developing roller 53*c*. At this stage of operation, some gap exists between the developing roller 53*c* and the master drum 51 and between the master drum 51 and a blanket, not shown, provided on the image transfer drum 54. Therefore, the developing roller 53*c* and master drum 51 and the master drum and image transfer drum 54 rotate without contacting each other. This is also true with the other image forming sections 60 through 80. The following description will concentrate on the operation of the image forming section 50 by way of example.

After the writing device 52 has written the image in the stencil 300, pressing means, not shown, presses the developing roller 53*c* against the master drum 51 in order to develop the image formed in the stencil or master 300 with the cyan ink. At the same time, pressing means, not shown, presses the master drum 51 against the image transfer drum 54. As a result, an ink image is transferred from the master 300 to the blanket of the image transfer drum 54.

In parallel with the above operation, the pickup roller 24 and separator roller 26 included in the sheet feeder 14 feed one paper sheet K from the tray 22 toward the registration roller pair 30. The registration roller pair 30 stops the paper sheet K so as to correct, e.g., the skew of the paper sheet K by extra feed or similar technology. The sheet conveying device 16 is driven such that the chains 36 turn at a preselected linear velocity. The registration roller pair 30 starts conveying the paper sheet K in synchronism with the opening of one of the clampers 38, which will be described later. The clamper 38 opened clamps the leading edge of the paper sheet K.

The clamper 38 clamping the paper sheet K conveys the paper sheet K in accordance with the movement of the chains 36. First, the image transfer roller 40 presses the paper sheet K against the image transfer drum 54, so that the cyan ink image is transferred from the drum 54 to the paper sheet K. Subsequently, a magenta ink image, a yellow ink image and a black ink image are sequentially transferred from the image transfer drums 64 through 84 to the paper sheet K over the cyan ink image. As a result, a multicolor image is completed on the paper sheet K.

Subsequently, the clamper 38 is opened to release the paper sheet K carrying the multicolor image thereon, as will be described specifically later. The paper sheet K is then driven out to the tray 20 by an outlet roller pair 90 along a guide 150. A pair of side fences (only one is visible) 92 are mounted on the tray 20 for positioning the paper sheet driven out to the tray 20. When use is made of slow-drying ink, fixing means may be positioned upstream of the outlet roller pair 90 for promoting the fixation of the ink image.

After a desired number of prints have been produced, the pressing means releases the developing roller 53*c* from the master drum 51 while the other pressing means releases the master drum 51 from the image transfer drum 54. Subsequently, pressing means, not shown, moves the cleaning roller 55*b* included in the cleaning device 55 such that the cleaning web 55*a* contacts the blanket of the image transfer drum 54. Drive means, not shown, causes the cleaning web 55*a* to be sequentially paid out while being taken up, wiping off the ink left on the blanket.

Reference will be made to FIGS. 3 through 15 for describing the construction and operation of the sheet conveying device 16 more specifically. As shown in FIG. 3, the drive pulleys 32 are mounted on a shaft 94 substantially parallel to the shaft 84*a* of the image transfer drum 84. The teeth of one drive pulley 32 and those of the other drive pulley 32 are aligned with each other in the axial direction of the image transfer drum 84. Likewise, the driven pulleys 34 are mounted on a shaft 96 substantially parallel to the shaft 84*a* with their teeth aligning with each other in the axial direction of the image transfer drum 84. This is also true with the other image transfer drums 54 through 74. In this configuration, the teeth of one chain 36 and those of the other chain 36 are coincident in phase with each other, so that the clampers 38 can be easily affixed to the chains 36 in substantially parallel to the shaft 84*a*.

The drive pulleys 32 are rotated clockwise, as viewed in FIG. 3. Therefore, one run of each chain 36 closer to the image transfer drums 54 through 84 is subjected to tension.

The chains 36 are passed over the drive pulleys 32 and driven pulleys 34 such that they are substantially perpendicular to the shaft 84*a* and run in substantially parallel to each other. The clampers 38 each are affixed to the chains 36 at opposite ends thereof substantially in parallel to the shafts 94 and 96. More specifically, each clamper 38 is affixed to the chains 36 in such a manner as to convey the paper sheet K in a position that is substantially tangential to the image transfer drums 54 through 84. In the illustrative embodiment, the chains 36 are implemented by toothed belts.

The chains 36 are spaced from each other by a distance W greater than the maximum sheet width, which is perpendicular to the direction of sheet conveyance, to be dealt with by the offset printer 2. This allows each clamper 38 to have a width greater than the maximum sheet width.

Bearings 98 each are received in an opening 100*a* formed in one of opposite side walls 100. The shaft 94, supporting the drive pulleys 32, is supported by the bearings 98 at opposite ends thereof.

The shaft 96, supporting the driven pulleys 34, are also supported by bearings 102 at opposite ends thereof. However, the bearings 102 each are affixed to one of opposite adjusting plates 104, which are positioned at the rear of the side walls 100. More specifically, the opposite ends of the shaft 96 each are passed through a vertical slot 100*b* formed in the associated side wall 100. Biasing means, not shown, constantly bias the adjusting plates 104 downward, as indicated by arrows B. The adjusting plates 104 are therefore movable substantially perpendicularly to the shaft 84*a* of the image transfer drum 84, exerting an adequate degree of tension on the chains 36. The bearings 102 are received in openings 104 formed in the adjusting plates 104.

Figure 4:
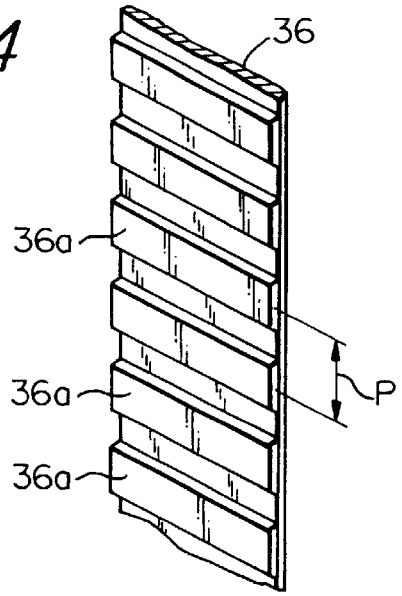
FIG. 4 is a fragmentary, enlarged isometric view of a chain included in the illustrative embodiment.

As shown in FIG. 4, assume that each chain 36 has teeth 36*a* arranged at a pitch P with a number of pitches n. Then, in the illustrative embodiment, the circumferential length nP of the chain 35 is selected to be an integral multiple of the number of teeth z of each drive pulley 32. More specifically, the following relations hold:

$$4L=nP$$

$$n=\alpha z$$

where $\alpha$ is an integer.

With the above relations, it is possible to easily synchronize the peripheral speed of the image transfer drum 84 and the conveying speed of the chains 36, i.e., the moving speed of the clampers 38. Consequently, the period of rotation of the image transfer drum 84 and the period of movement of the clampers 38 can be accurately synchronized to each other.

Figure 5A:
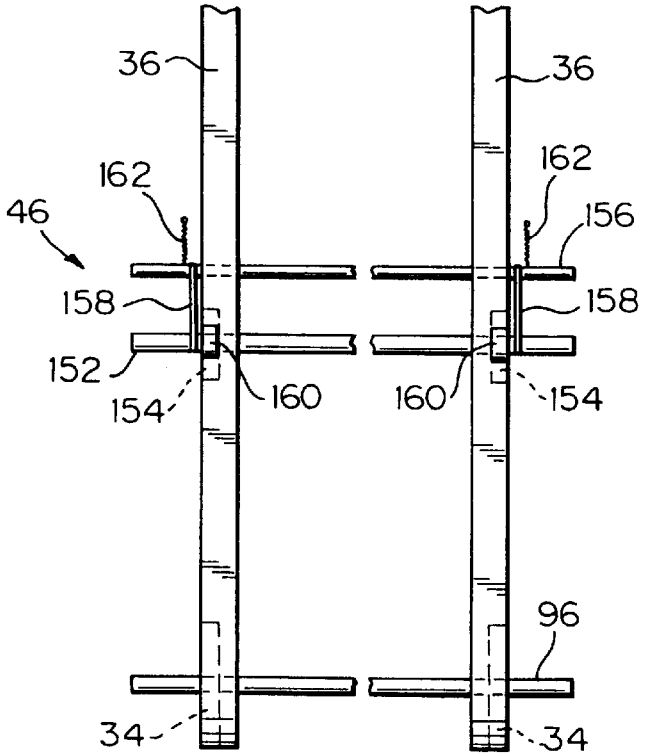
FIG. 5A is a side elevation showing a stabilizing mechanism included in the illustrative embodiment for stabilizing the movement of chains.
Figure 5B:
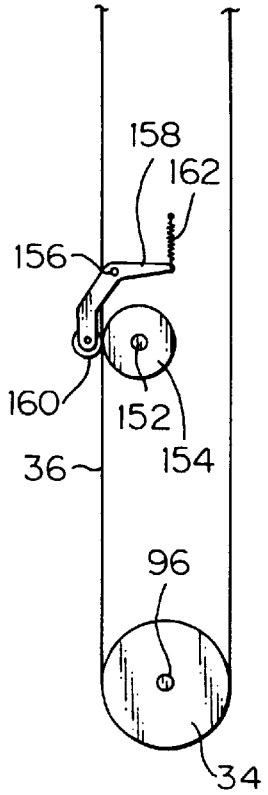
FIG. 5B is a fragmentary view of the stabilizing mechanism.

The stabilizing mechanisms 46 will be described specifically with reference to FIGS. 5A and 5B. As shown, each stabilizing mechanism 46 includes a support shaft 152 and idler pulleys 154 rotatably mounted on opposite ends of the support shaft 152. The idler pulleys 154 each are positioned between the opposite runs of the associated chain 36. Another support shaft 156 rotatably supports generally L-shaped levers 158 at opposite ends thereof. The levers 158 each rotatably support a respective pressing roller 160 at one end thereof. The pressing roller 160 faces the idler pulley 154 and presses the outer surface of the chain 36 against the idler pulley 154. Springs 162 each constantly bias one of the pressing rollers 160 in the direction in which the roller 160 contacts the idler pulley 154 via the chain 36.

The support shaft 152 is supported by opposite side walls, not shown, included in the printer body. The idler pulleys 154 are held in contact with the inner surfaces of the tense sides of the chains 36. The idler pulleys 154 prevent the chains 36 from being shifted more than expected relative to the image transfer drums 54 through 84. The other support shaft 156 is also supported by the opposite side walls of the printer body.

During printing, the idler pulleys 154 and pressing rollers 160 nip the associated chains 36 therebetween. The chains 36 can therefore run at a preselected distance from the image transfer drums 54 through 84. This successfully stabilizes the locus of conveyance of the paper sheet K as well as the transfer of ink images.

Figure 6A:
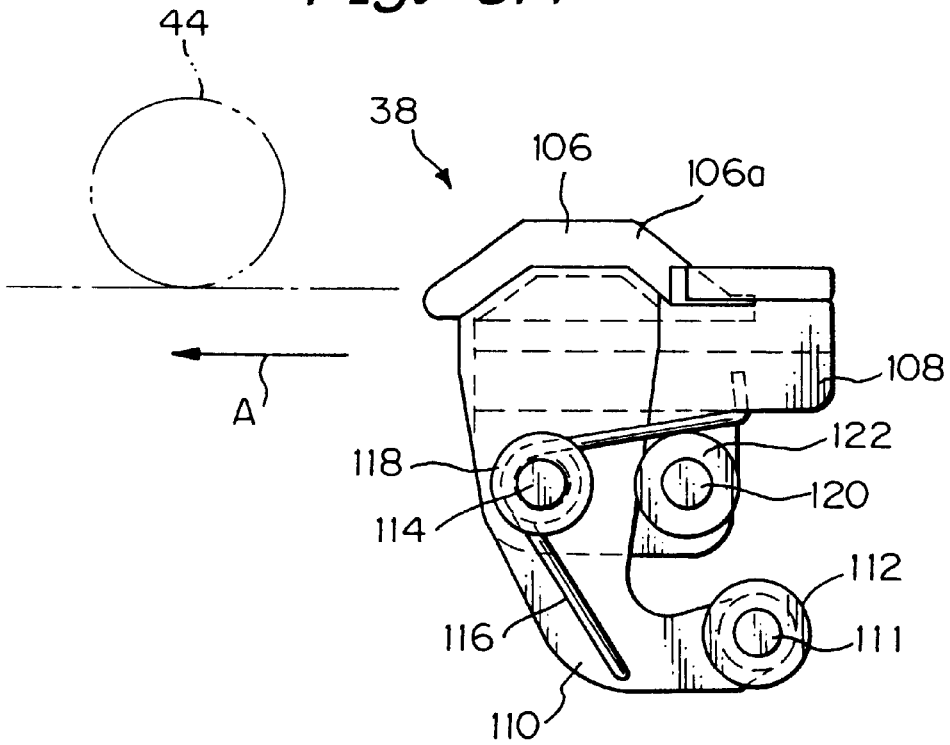
FIG. 6A is a rear view showing a clamper included in the illustrative embodiment.
Figure 6B:
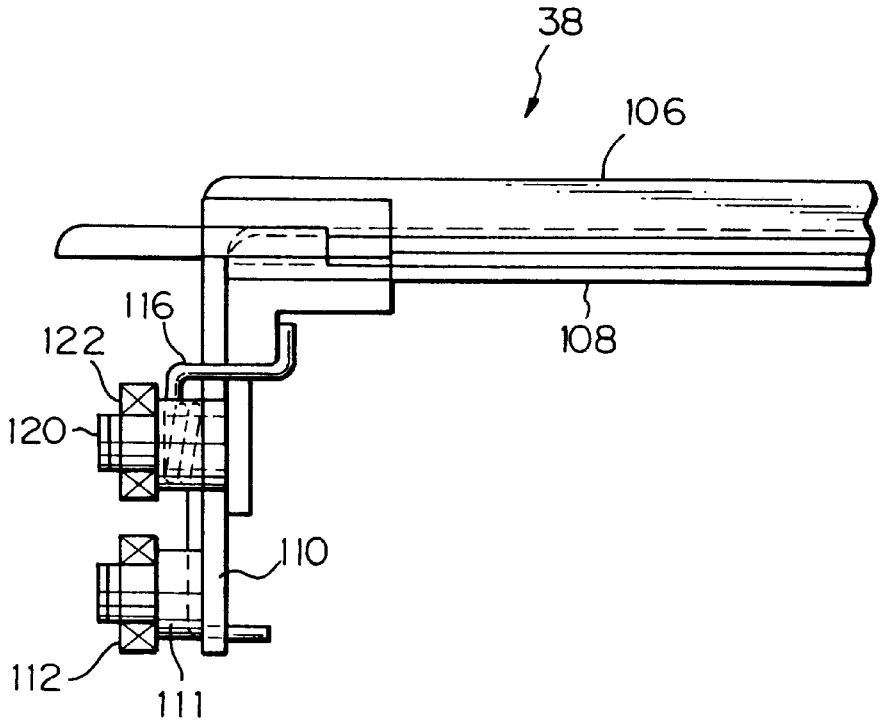
FIG. 6B is a side elevation of the clamper.

As shown in FIGS. 6A and 6B, each clamper 38 includes an upper clamp member 106 and a lower clamp member 106 for clamping the paper sheet K therebetween. Generally L-shaped arms 110 (only one is visible) each are formed integrally with one of opposite ends of the upper clamp member 106. A stub 111 is formed integrally with the free end of the arm 110 and supports a cam follower 112.

Stubs 114 (only one is visible) are also formed integrally with the arms 110 of the lower clamp member 108 and rotatably support the upper clamp member 106. A spring 116 is fitted on the axially outer portion of each stub 114, constantly biasing the upper and lower clamp members 106 and 108 in the direction in which they close. The biasing force of the spring 116 is selected to be small enough to leave no clamp marks on the paper sheet K, but great enough to maintain the position of the clamper 38 during conveyance.

More specifically, one end of the spring 116 is bent substantially perpendicularly and retained by the inner portion of the lower clamp member 108. The other end of the spring 116 is also bent substantially perpendicularly and passed through the arm 110 from the inside to the outside to be retained thereby.

A cam follower or contact portion 118 is mounted on the stub 114 outside of the spring 116. A stub 120 is formed integrally with the lower clamp member 108 and spaced from the stub 114 in the direction of paper conveyance A. The stub 120 supports a cam follower or another contact portion 122 corresponding in position to the cam follower 118.

The upper clamp member 106, which protrudes outward from the outer surface of the chains 36, sequentially decreases in thickness, as measured from the chains 36, in the direction of sheet conveyance A. With this configuration, the clamp member 106 is capable of colliding against various rollers arranged on the conveyance path of the chains 36 with a minimum of shock and noise, while causing the rollers to retract away from the chains 36. For example, the clamp member 106 collides against the roller 44 with a minimum of shock and noise while causing it to retract away from the chains 36.

Figure 7:
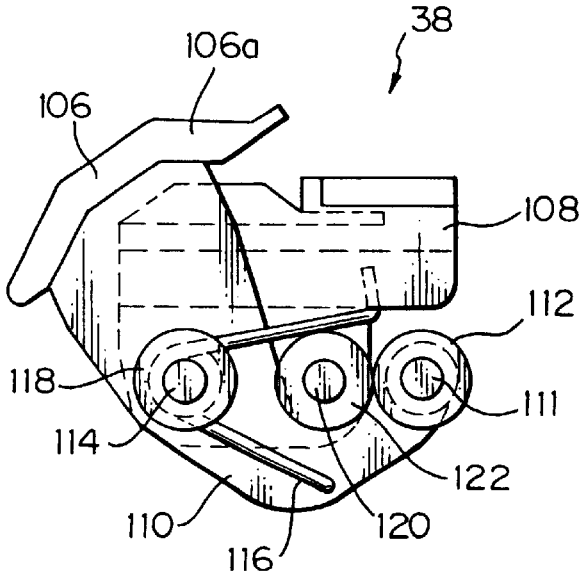
FIG. 7 is a rear view showing the clamper in an open position.

As shown in FIG. 7, when the cam follower 112 is brought into contact with a cam, which will be described later, the upper clamp member 106 rotates about the stubs 114 with the result that the clamper 38 opens.

Figure 8:
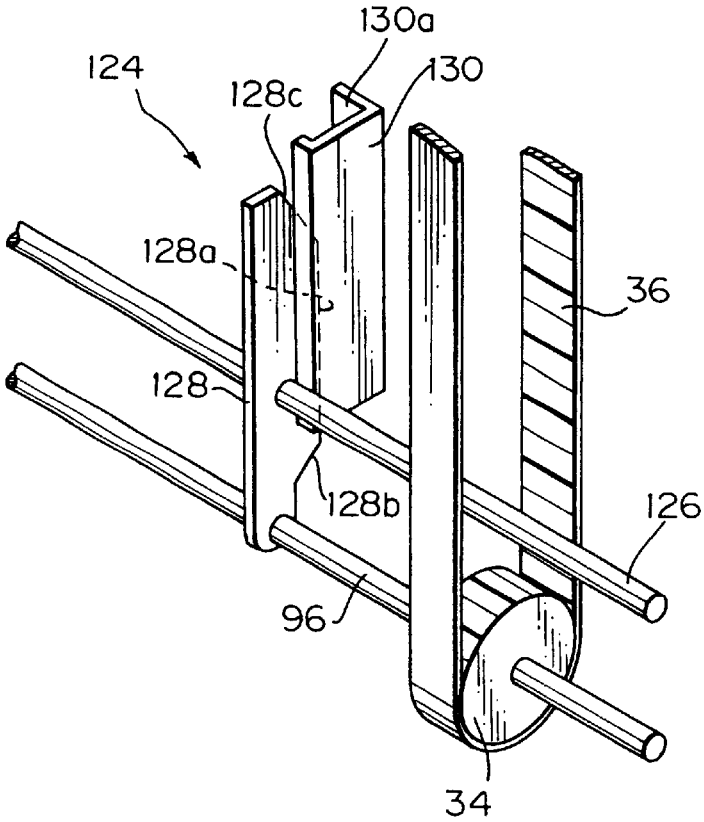
FIG. 8 is an isometric view of cam means for sheet feed included in the illustrative embodiment.

As shown in FIG. 8, a cam mechanism 124 for sheet feed (not shown in FIG. 1 or 3) is associated with each driven pulley 34. The cam mechanism 124 includes the rotatable shaft 96 and a support shaft 126 extending substantially in parallel to each other. The support shaft 126 extends throughout and fixedly supports a cam 128, so that the entire cam 128 remains stable without any angular movement. A guide member 130 is affixed to the cam 128 in order to prevent the chain 36 from shaking in the event of opening and closing of the clamper 38.

Specifically, the cam 128 includes a pressing surface 128*a* and a releasing surface 128*b* contiguous with each other. The pressing surface 128*a* presses the cam follower 112 of the arm 110 to thereby open the clamper 38. The releasing surface 128*b* cancels the pressure acting on the cam follower 112. The cam 128 additionally includes an inclined surface 128*c* contiguous with the pressing surface 128*a* and positioned at the clamper ingress side. The inclined surface 128*c* allows the cam follower 112 to smoothly enter the cam mechanism 124. The guide member 130 has a generally U-shaped cross-section and includes a wall 130*a* for guiding the cam followers 118 and 122.

Figure 9:
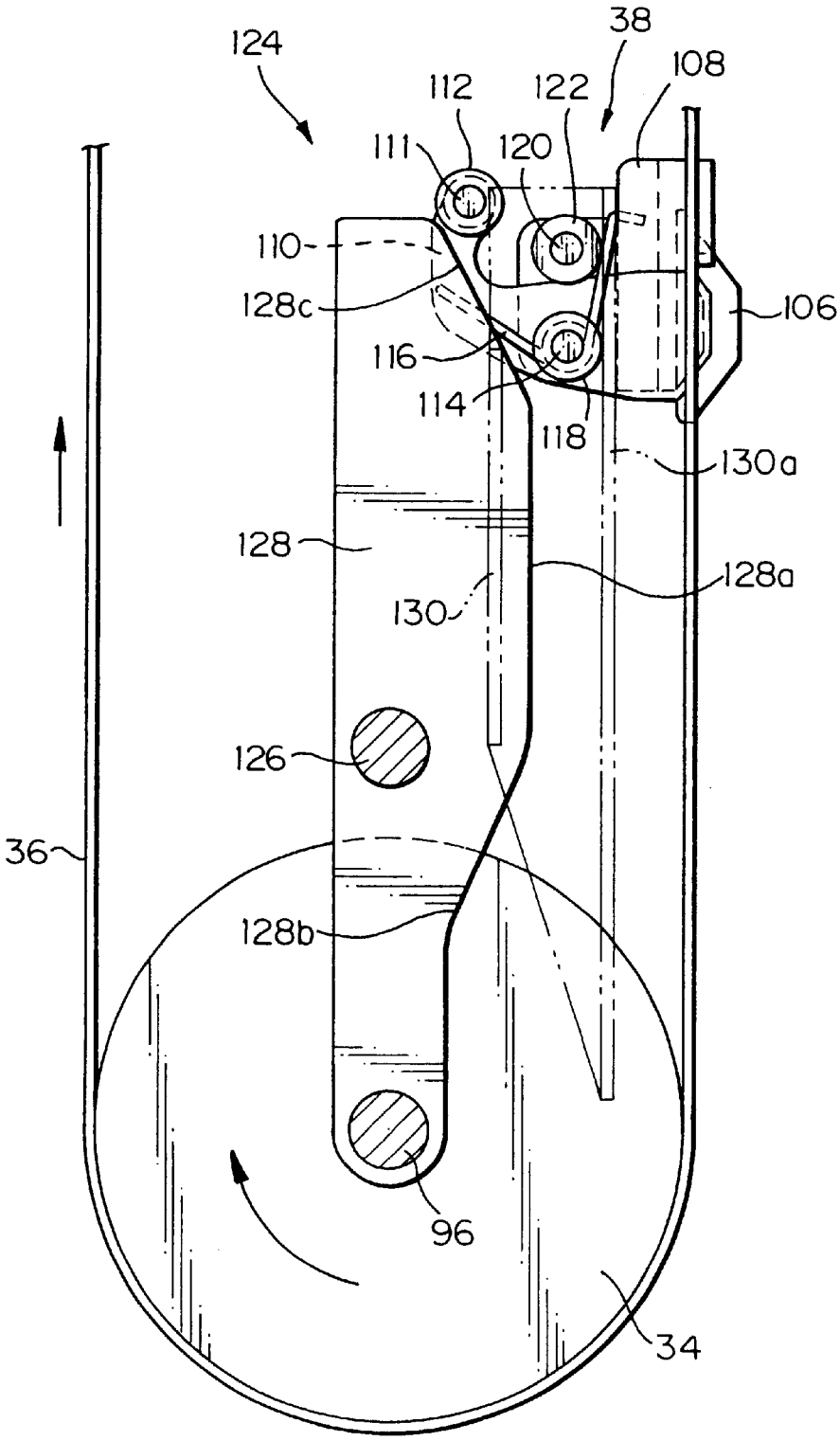
FIG. 9 is a front view showing the clamper that is about to open at a sheet feed position.
Figure 10:
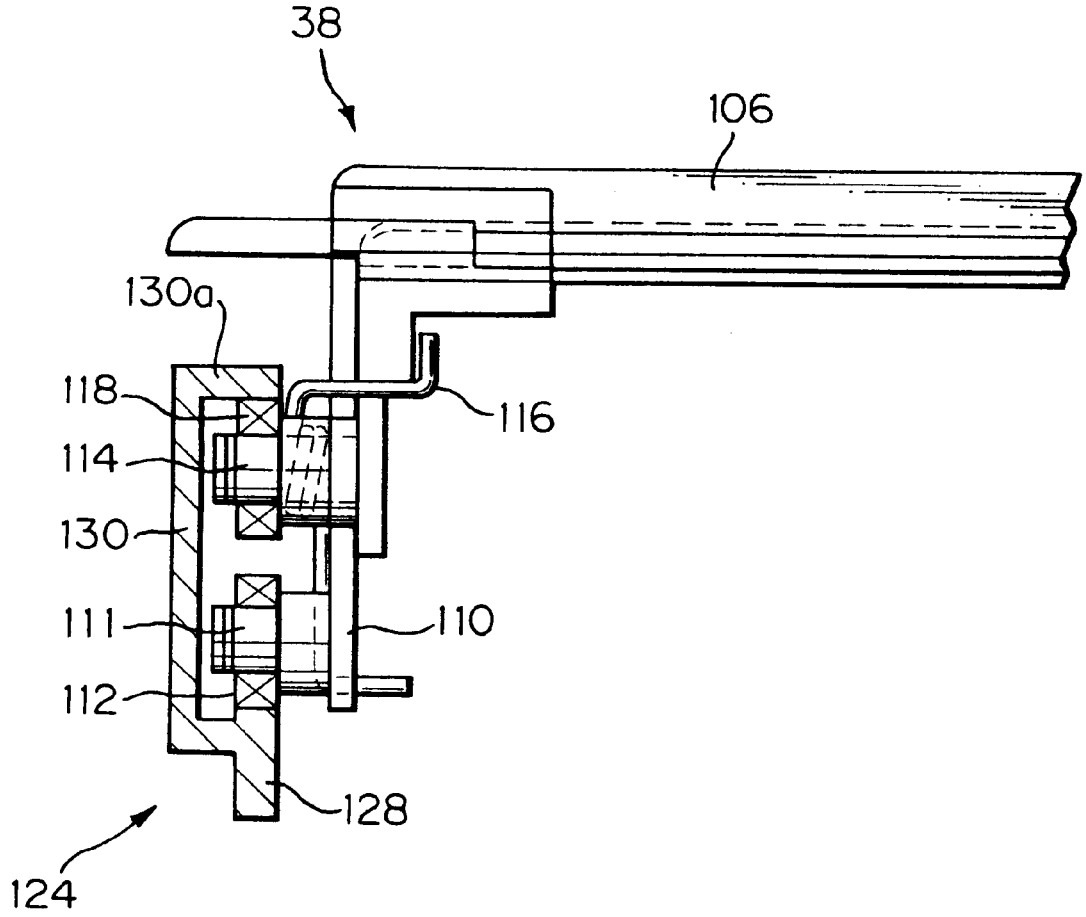
FIG. 10 is a side elevation showing the clamper in the same condition as in FIG. 9.

FIG. 9 shows a condition in which the clamper 38 is about to open, i.e., the cam follower 112 is brought into contact with the upper end of the inclined surface 128*c* of the cam 128. At this instant, the cam followers 118 and 122 have already entered the guide member 130 and are being guided by the wall 130*a* of the guide member 130, as shown in FIG. 10.

Figure 11:
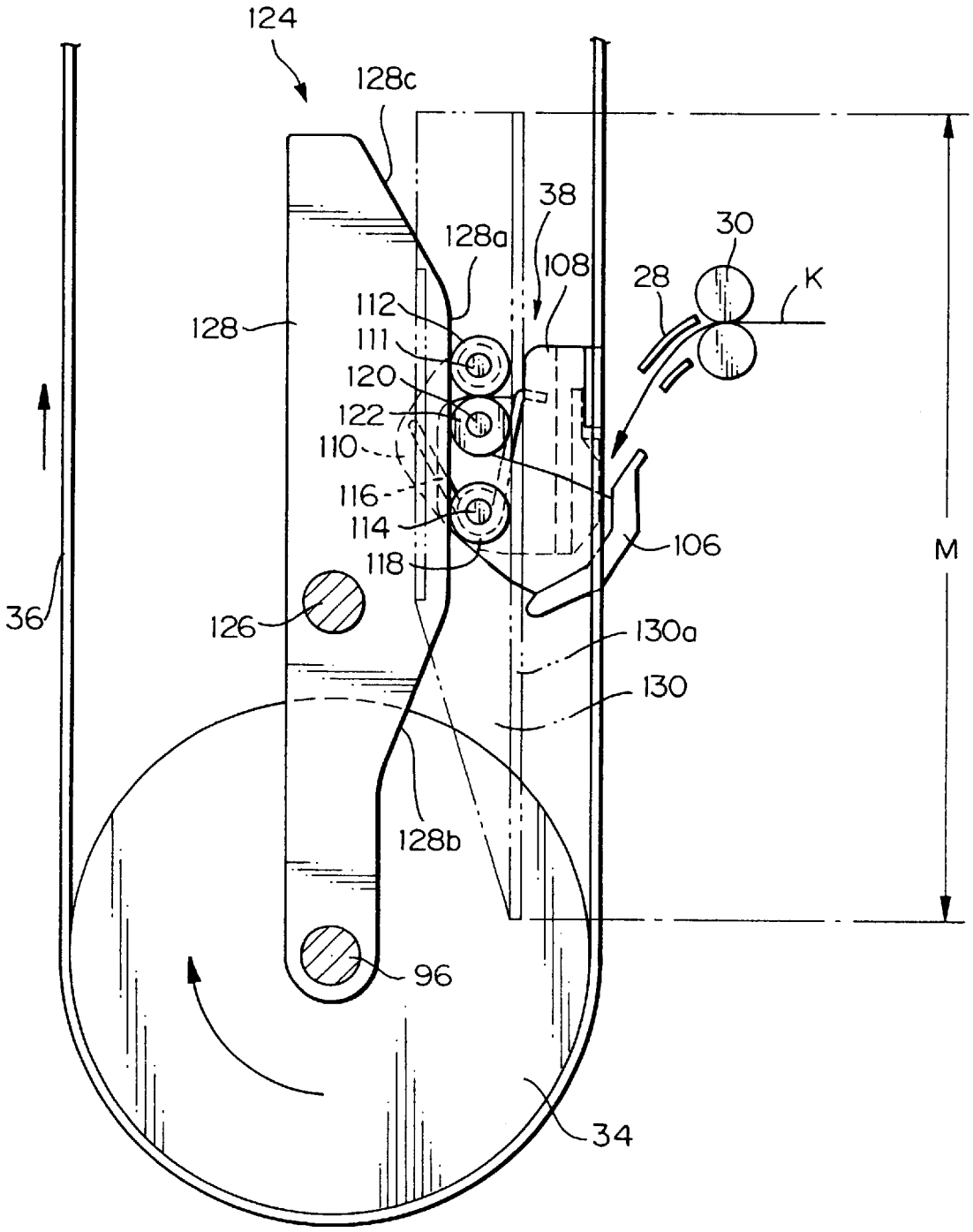
FIG. 11 is a front view showing the clamper opened at the sheet feed position.

As shown in FIG. 11, as the clamper 38 moves toward the driven pulleys 34, the cam follower 112 is transferred from the inclined surface 128*c* to the flat pressing surface 128*c*. At this instant, the arm 110 rotates against the action of the spring 116, so that the resulting reaction acts on the lower clamp member 108 affixed to the chains 36.

The chains 36 are subjected to tension, as stated earlier. The chains 36, however, have some play in order to move between the drive pulleys 32 and the driven pulleys 34 and are therefore apt to shake when subjected to an extraneous force. Consequently, when the clamper 38 opens, the chains 36 are apt to move outward with the result that the open angle thereof relative to the sheet clamping position and sheet conveyance path varies. It is to be noted that the guide member 130 is indicated by a dash-and-dots line for clarity.

In the illustrative embodiment, the lower clamp member 108 contacts the wall 130*a* of the guide member 130 at two points, i.e., with the cam followers 118 and 122. This cancels a bending moment acting on the lower clamp member 108 and thereby allows the clamp member 108 and chains 26 to move without shaking.

Figure 12:
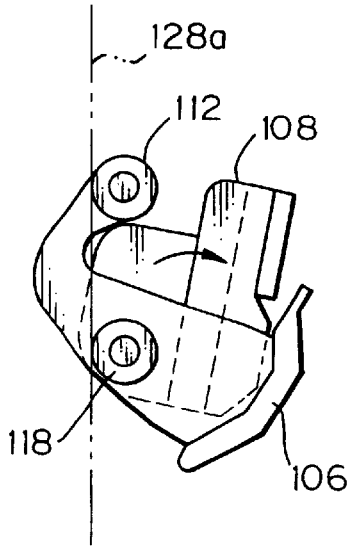
FIG. 12 is a view demonstrating how the open angle of the clamper would vary if guide members were absent.

More specifically, as shown in FIG. 12, assume that the guide member 130 is absent. Then, the reaction of the spring 116 causes a moment to act on and rotate the lower clamp member 108, so that the open angle of the clamper 38 varies. By contrast, in the illustrative embodiment, the pressing surface 128*a* and wall 130*a* nip the cam followers 112 and 118 therebetween. The pressing surface 128*a* guides the cam followers 112 and 118 while the wall 130*a* guides the cam follower 122. This successfully cancels the moment ascribable to the reaction of the spring 116 for thereby insuring the adequate open angle of the clamper 38 relative to the sheet conveyance path.

As shown in FIG. 11, when the clamper 38 is open, the paper sheet K fed from the registration roller pair 30 at the previously mentioned timing is introduced into the clamper 38. When the cam follower 112 starts moving downward along the releasing surface 128*b*, the arm 110 restores its original position little by little due to the action of the spring 116, causing the clamper 38 to close. As a result, the clamper 38 clamps the leading edge of the paper sheet K between the upper clamp member 106 and the lower clamp member 108.

The bias of the spring 116 acts even when the clamper 38 closes. The clamper 38 and chains 38 are therefore apt to shake and thereby vary the sheet clamping position as when the clamper 38 opens. In light of this, in the illustrative embodiment, the guide member 130 is provided with a length M in the direction of sheet conveyance great enough to maintain the above-described function until the bias of the spring 116 ends acting, i.e., until the cam follower 112 leaves the releasing surface 128*b*.

Figure 13:
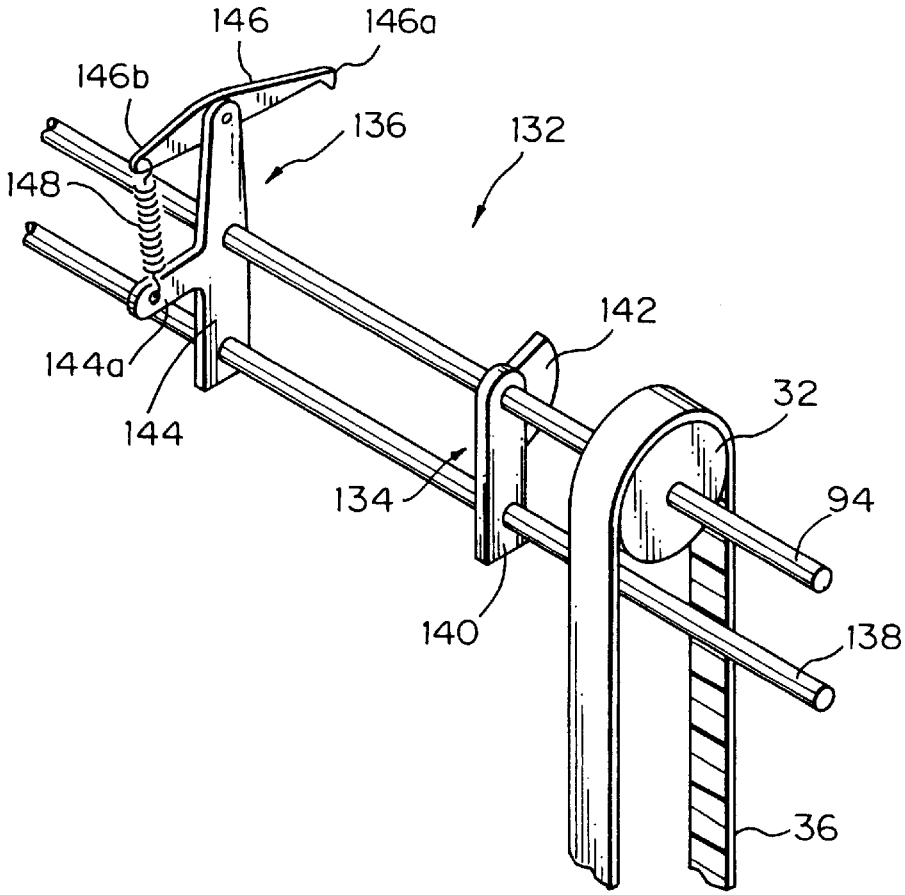
FIG. 13 is an isometric view of cam means for sheet discharge included in the illustrative embodiment.

As shown in FIG. 13, a cam mechanism 132 for sheet discharge (not shown in FIG. 1 or 3) is associated with each drive pulley 32. The cam mechanism 132 includes a cam 134 and a forcing mechanism 136 for forcing the paper sheet 36 outward of the chains 36 in accordance with the opening movement of the clamper 38. The cam 134 is made up of a cam base 140 and a sectorial cam portion 142 formed integrally with each other. The shaft 94 and a support shaft 138 substantially parallel to each other extend throughout the cam base 140. The support shaft 138 fixedly, stably supports the entire cam 134.

The forcing mechanism 136 includes abase member 144. The shaft 94 and support shaft 138 also extend throughout the base member 144. The support shaft 138 fixedly, stably supports the entire base member 144. A lever 146 is rotatably supported by the base member 144. A spring or biasing member 148 is anchored at one end to one end 146*b* of the lever 146 and at the other end to an arm 144*a*, which is included in the base member 144.

Figure 14:
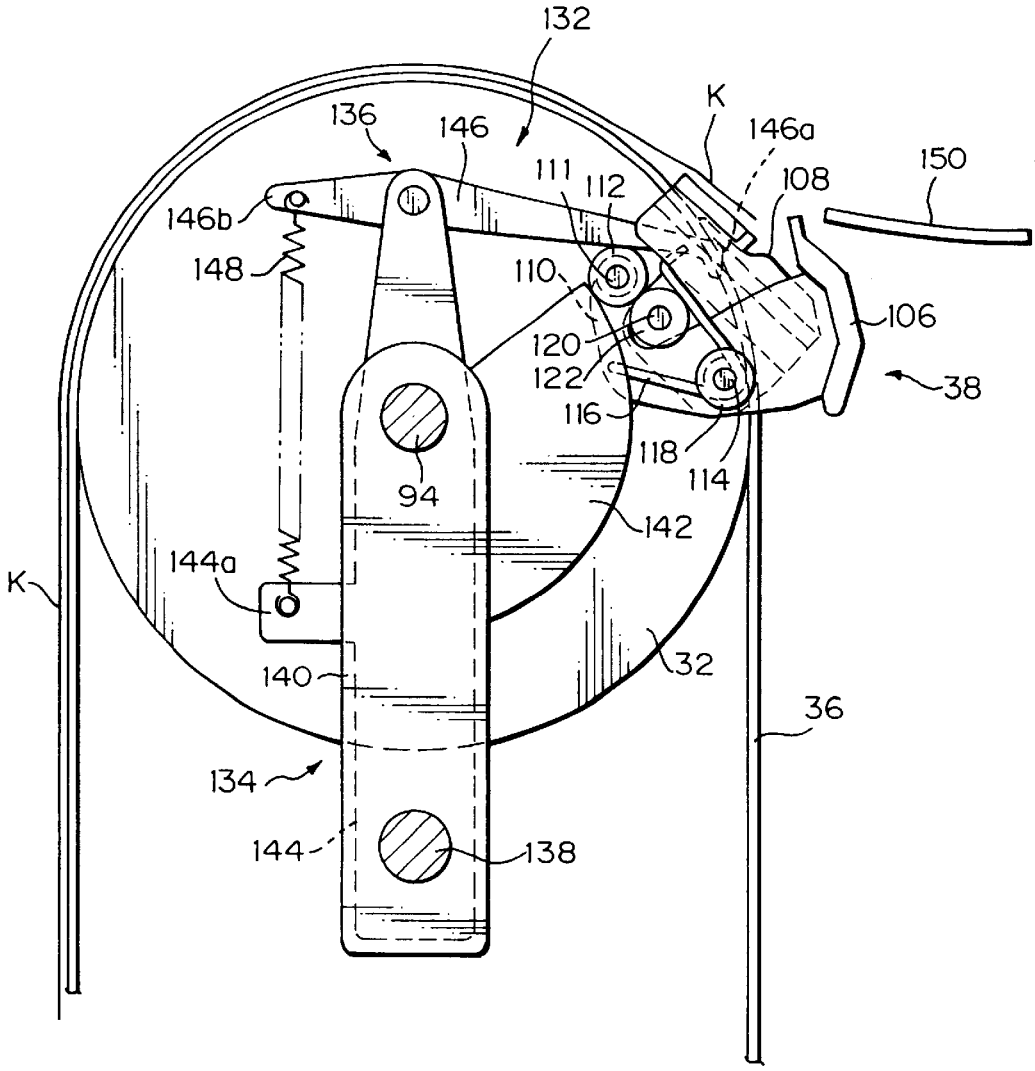
FIG. 14 is a front view showing the cam means for sheet discharge that has released a paper sheet.

As shown in FIG. 14, when the clamper 38 clamping the paper sheet or print Karrives at a preselected position around the drive pulley 32, the other end 146*a* of the lever 146 contacts the lower clamp member 108 of the clamper 38. Consequently, the lever 146 rotates about the base member 144 in accordance with the movement of the clamper 38 while stretching the spring 148. An arrangement is made such that when the cam 142 presses the cam follower 112 to cause the clamper 38 to open, the end 146*a* of the lever 146 is released from the lower clamp member 108.

Figure 15:
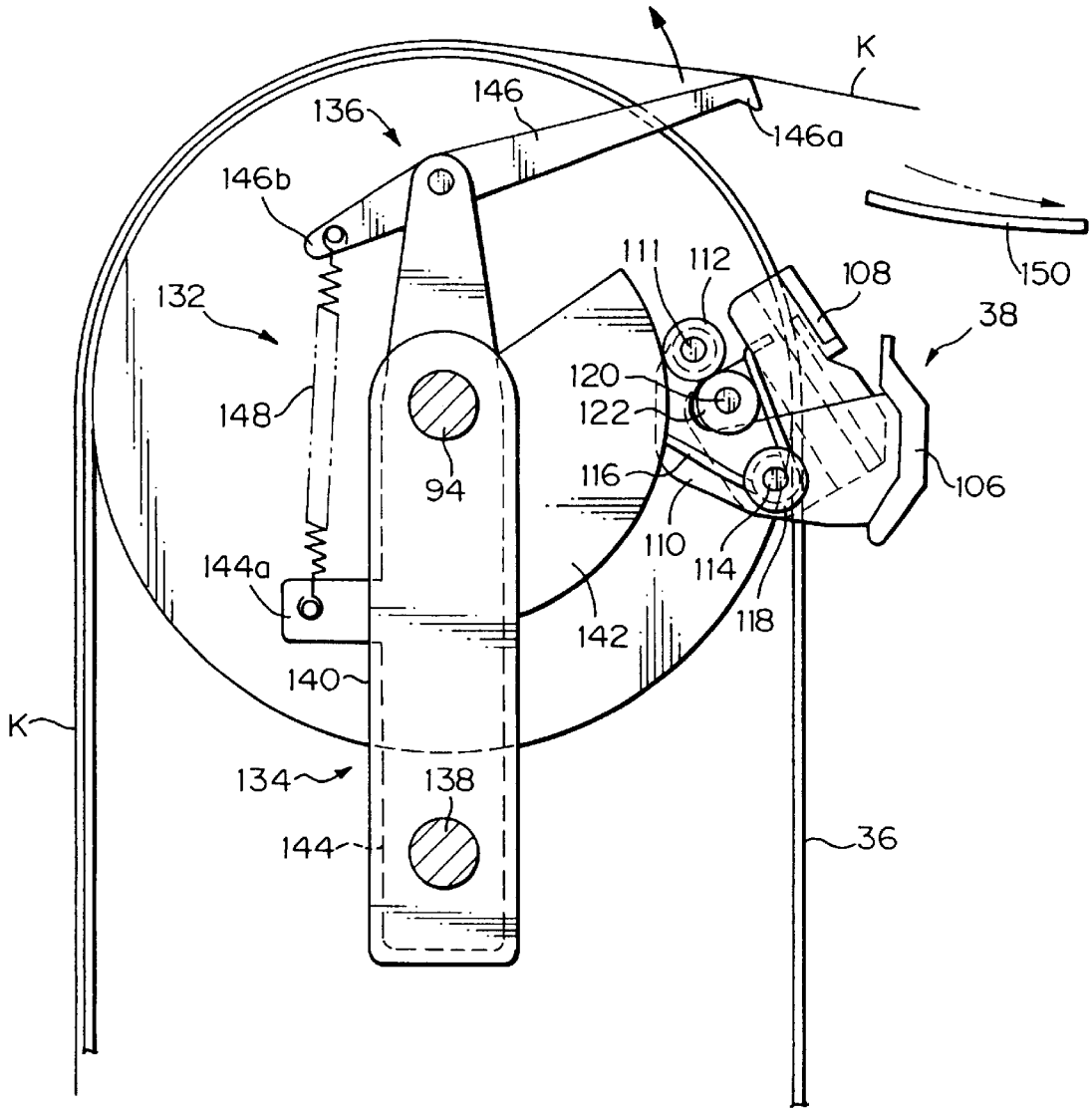
FIG. 15 is a front view showing how a forcing mechanism included in the illustrative embodiment flips a paper sheet.

As shown in FIG. 15, when the end 146*a* of the lever 146 is released from the lower clamp member 108, the lever 146 resiliently restores its original position due to the action of the spring 148. At this instant, the end 146*a* of the lever 146 flips the paper sheet K outward of the chains 36. The paper sheet K is then guided by a guide member 150 to the outlet roller pair 90. If desired, the lever 146 itself maybe implemented as, e.g., a leaf spring and affixed to the base member 144 in order to omit the spring 148.

While the sheet conveying device 16 has been shown and described as being arranged in the image transferring path, it is similarly applicable to a path for discharging the paper sheet or pint K or a path for conveying the paper sheet K from the sheet feeder 14 to the image transferring path.

The chain-delivery type of conveying system is advantageous over a press-drum type of conveying system even when a single image carrier is substituted for a plurality of image carriers. That is, the chain-delivery type of system reduces the overall height or the overall width, i.e., the overall size of a printer. Moreover, the chain-delivery type of system promotes free design, e.g., allows an ink drying step to be added only if the length of the chains is increased. These advantages hold true with the printer including a plurality of image carriers as well.

Reference will be made to FIGS. 16 through 21 for describing an alternative embodiment of the present invention. The structural elements of the alternative embodiment identical with the structural elements of the previous embodiment are designated by identical reference numerals and will not be described specifically in order to avoid redundancy.

Figure 16:
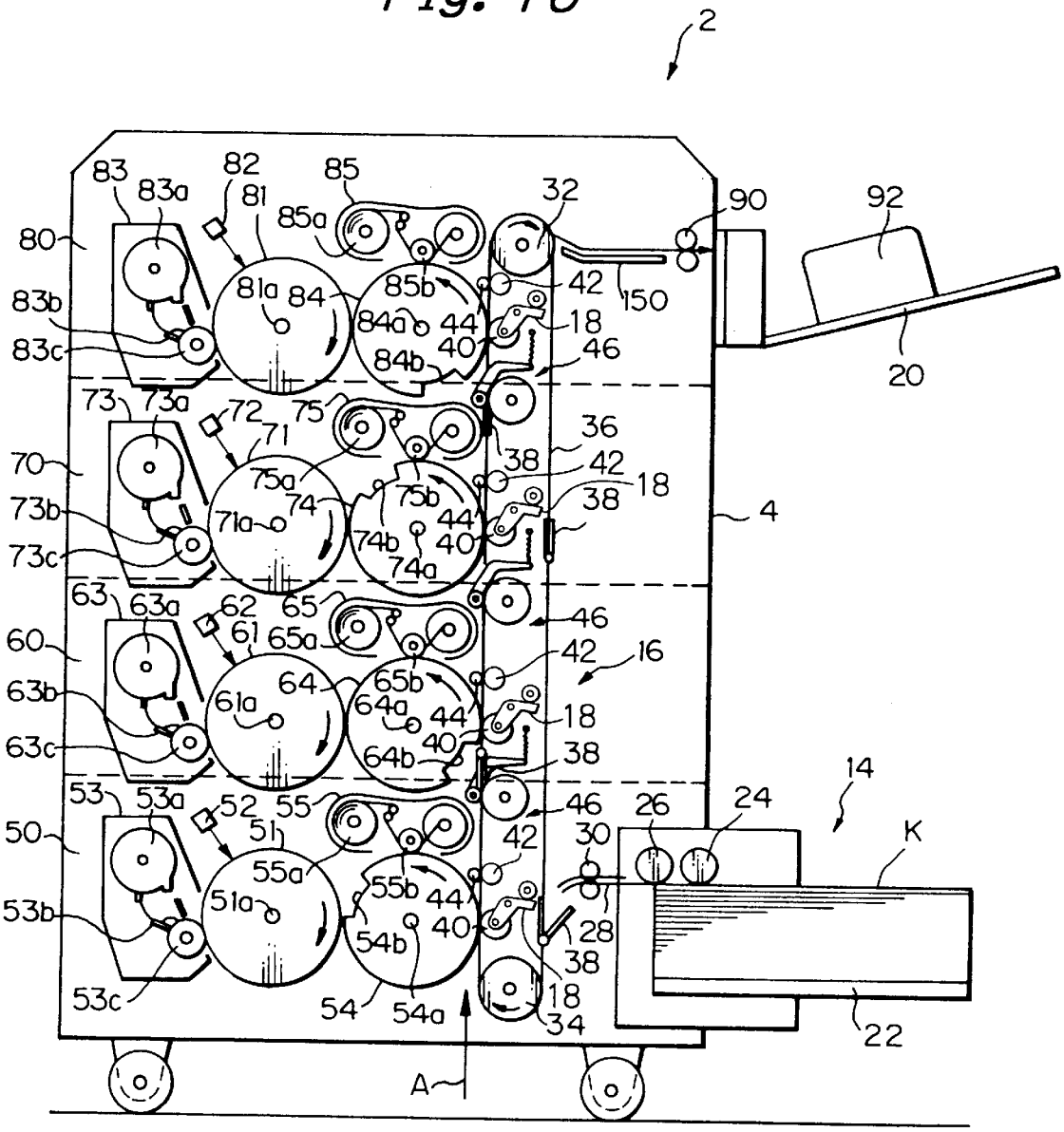
FIG. 16 is a front view showing an alternative embodiment of the present invention.

As shown in FIG. 16, the printer 2 additionally includes moving mechanisms 18 each being assigned to one of the image transfer rollers 40. The moving mechanisms 18 each selectively move the associated image transfer roller 40 into or out of contact with the image transfer drum 54, 64, 74 or 84 that faces the above image transfer roller 40.

Figure 17:
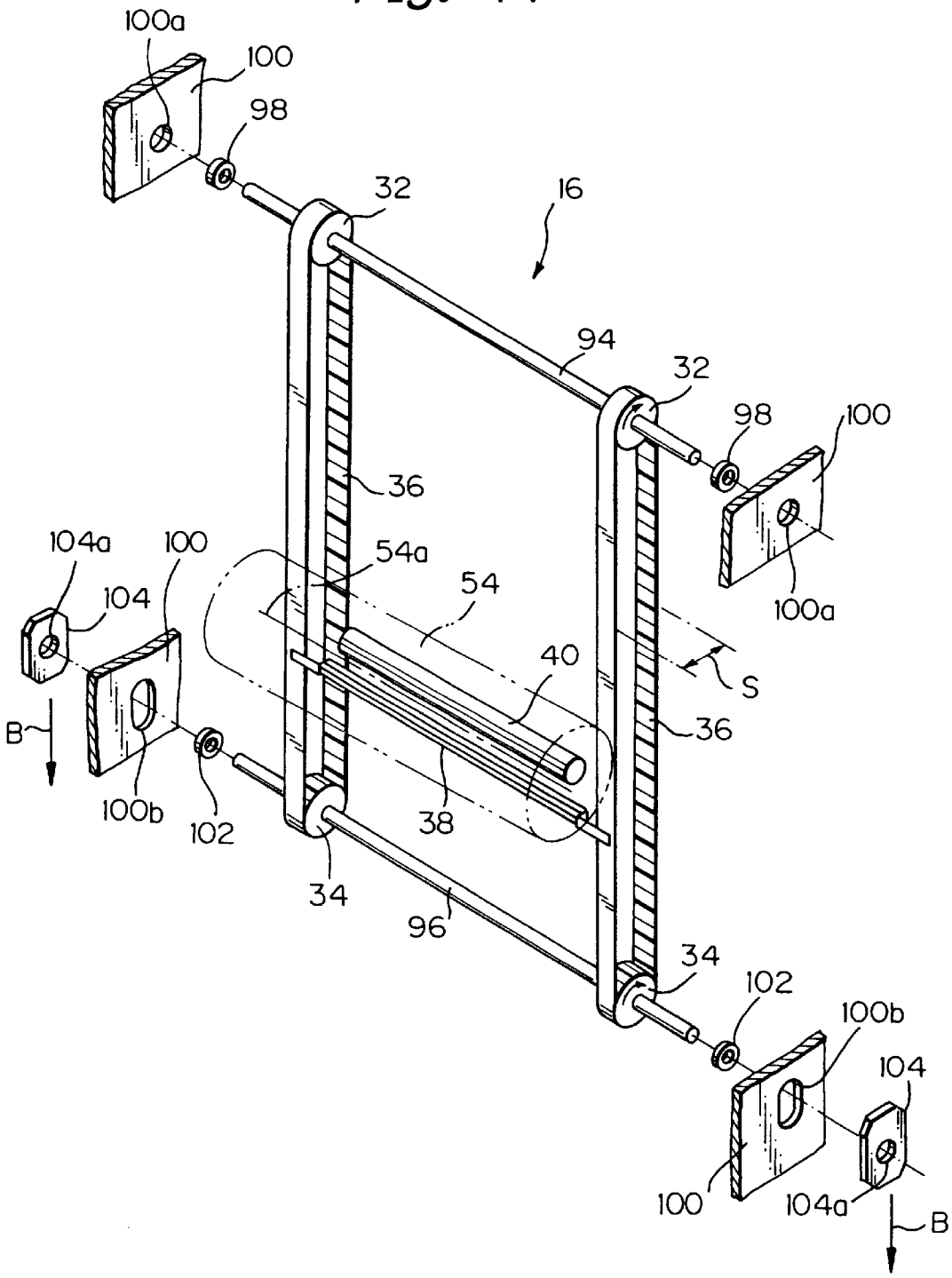
FIG. 17 is an isometric view of a sheet conveying device included in the alternative embodiment.

As shown in FIG. 17, in the illustrative embodiment, each image transfer roller 40 has a smaller diameter than the image transfer drums 54 through 84. The chains 36 each are passed over the associated drive roller 32 and driven roller 34 in the form of an elongate loop. The distance S between opposite runs of each chain 36 is uniform in the direction of sheet conveyance. The image transfer roller 40 has a diameter smaller than the above distance S, i.e., smaller than the diameter of the drive pulley 32 and driven pulley 34, which are toothed pulleys.

Figure 18:
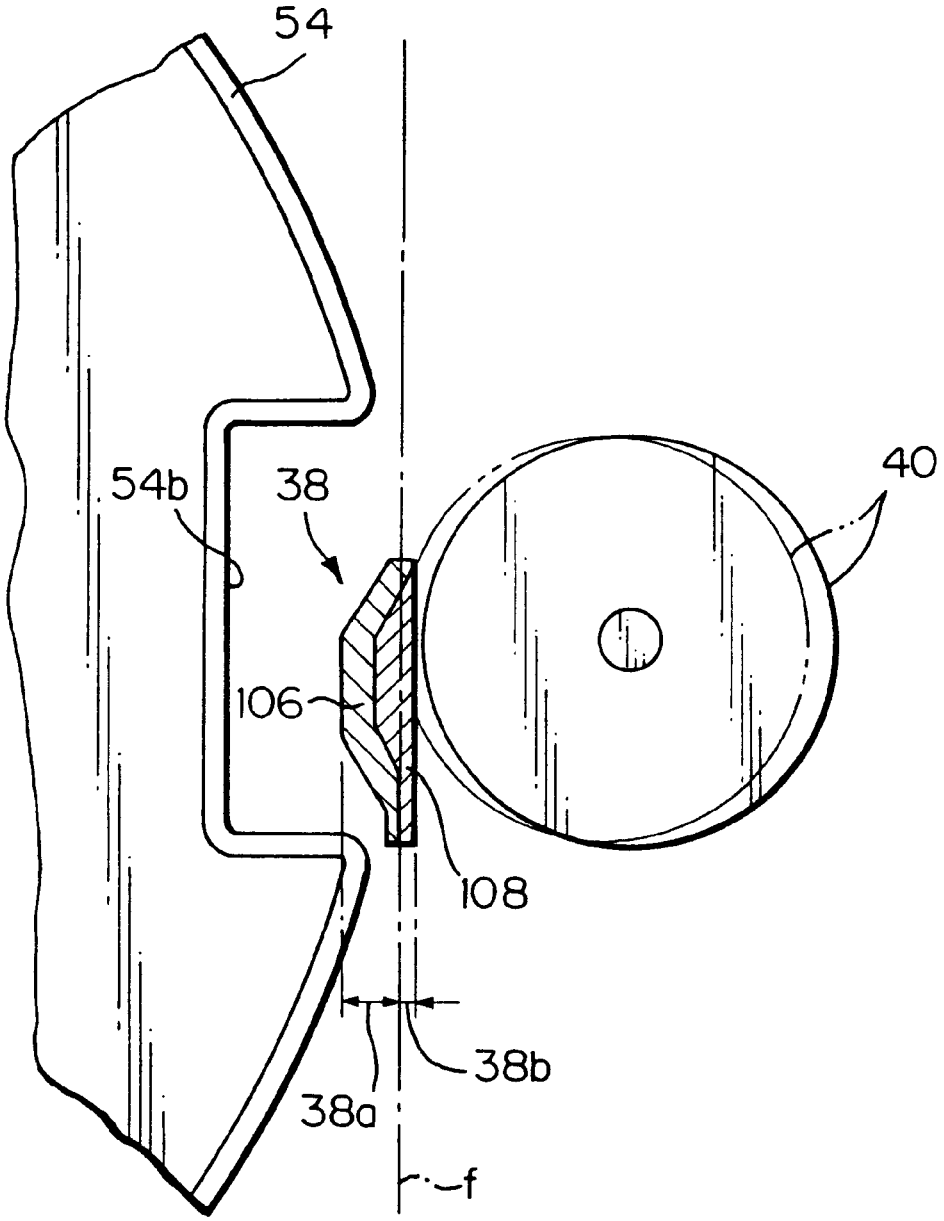
FIG. 18 is a front view showing a relation between an image transfer drum, a clamper and an image transfer roller included in the alternative embodiment.
Figure 19E:
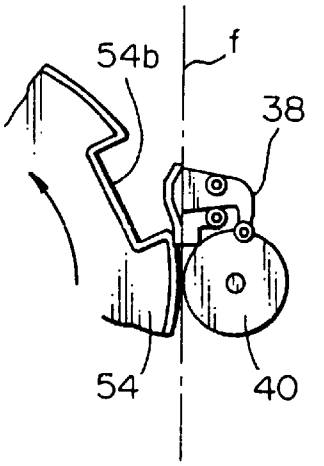
FIGS. 19A through 19E are front views demonstrating a sequence of steps in which the clamper of the alternative embodiment passes an image transfer position.
Figure 19D:
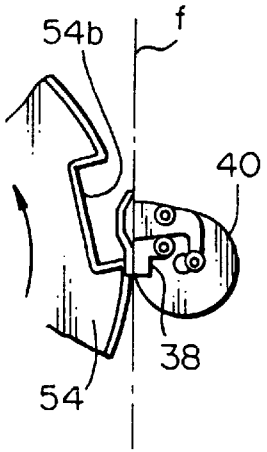
Figure 19C:
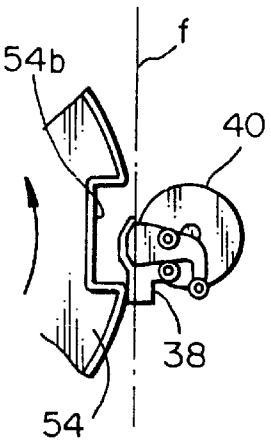
Figure 19B:
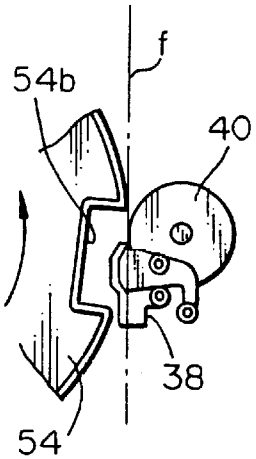
Figure 19A:
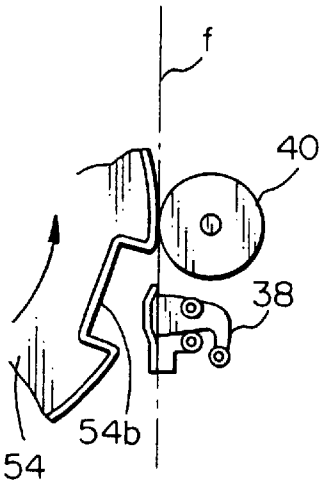

As shown in FIG. 18, substantially the entire portion 38*a* of the clamper 38 clamping the paper sheet K protrudes toward the image transfer drum 54 (64, 74 or 84) over the sheet conveyance plane f. The recess 54*b* (64*b*, 74*b* or 84*b*) of the drum 54 (64, 74 or 84) is sized great enough to accommodate the portion 38*a* without any interference when the clamper 38 arrives at the drum 54. Further, the clamper 38 has a portion 38*b* closer to the image transfer roller 40 with respect to the conveyance plane f. The portion 38*b* is flat and extremely thin. The portion 38*a* determines a configuration in which the clamper 38 clamps the paper sheet K as well as the mechanical strength of the clamper 38.

FIGS. 19A through 19E show how the clamper 38 passes the image transfer position assigned to the image transfer drum 54 by way of example. As shown, when the clamper 38 passes the image transfer position, the recess 54*b* of the image transfer drum 54 moves in synchronism with the movement of the clamper 38. Also, the moving mechanism 18 assigned to the image transfer roller 40 retracts the roller 40 to a position indicated by a solid line in FIG. 18 in synchronism with the movement of the clamper 38. Therefore, noise ascribable to the collision of the clamper 38 against the image transfer roller 40 is substantially obviated. In addition, variation in the torque of a driveline is obviated that would otherwise occur when the clamper 38 passes the image transfer position while being nipped between the roller 40 and drum 54. Further, when the clamper 38, passing the image transfer position, is free from unnecessary forces and can clamp the paper sheet K with a constant force; otherwise, the paper sheet K would slip out of the clamper 38.

Figure 20B:
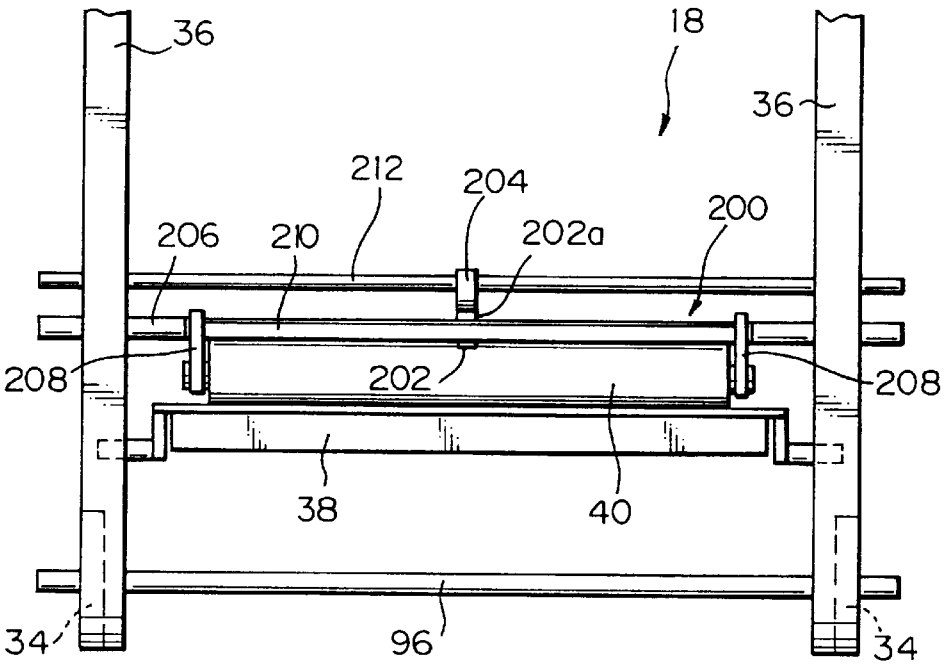
FIG. 20B is a side elevation of the moving means shown in FIG. 20A.
Figure 20A:
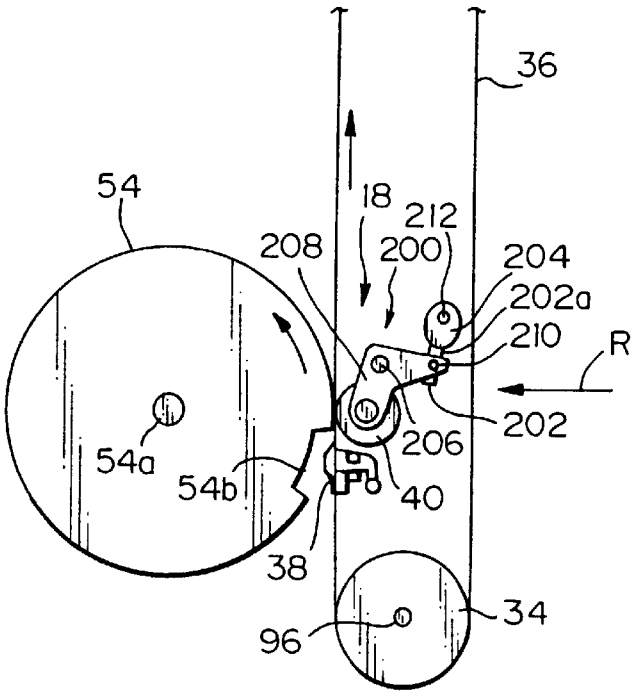
FIG. 20A is a view of moving means included in the alternative embodiment and assigned to the image transfer roller.

Referring to FIGS. 20A and 20B, the moving mechanisms 18 will be described more specifically. FIG. 20B is a view as seen in a direction indicated by an arrow R in FIG. 20A. As shown, each moving mechanism 18 includes a support member 200 rotatably mounted on the printer body and supporting the image transfer roller 40 at one end thereof. A screw or pressure adjusting screw 202 is held in threaded engagement with the other end of the support member 200. A cam or press cam 204 contacts the screw 202.

The support member 200 is made up of a pressing shaft 206, a pair of generally L-shaped levers 208, and a pressure adjusting shaft 210. The pressing shaft 206 is journalled to the previously mentioned side walls 100. The levers 208 are mounted on the pressing shaft 206 and spaced from each other in the direction perpendicular to the direction of sheet conveyance. The pressure adjusting shaft 210 extends between one end of the two levers 208. The levers 208 rotatably support the image transfer roller 40 at their ends opposite to the pressure adjusting shaft 210 with some bearing gap.

The screw 202 mates with a threaded hole formed in substantially the intermediate portion of the pressure adjusting shaft 210. The screw 202 has a flat head 202*a* which the cam 204 is capable of slidingly contact. The cam 204 is affixed to a drive shaft 212 that is journalled to the side walls 100. The drive shaft 212 is connected to a drive source, not shown, and caused to rotate in synchronism with the movement of the clamper 38.

The depth to which the screw 202 is driven into the threaded hole of the pressure adjusting shaft 210 is adjustable in order to vary the distance between the pressure adjusting shaft 210 and the screw 202, i.e., the angular position of the image transfer roller 40 relative to the image transfer drum 54. This allows the pressure that the image transfer roller 40 exerts on the image transfer drum 54 to be adjusted.

Further, in the illustrative embodiment, the image transfer roller 40, pressing shaft 206 and pressure adjusting shaft 210 each are supported by the levers 208 with some bearing gap or play in a balancing toy fashion. The image transfer roller 40 can therefore exert a uniform pressure on the image transfer drum 54 over the entire axial length.

Figure 21B:
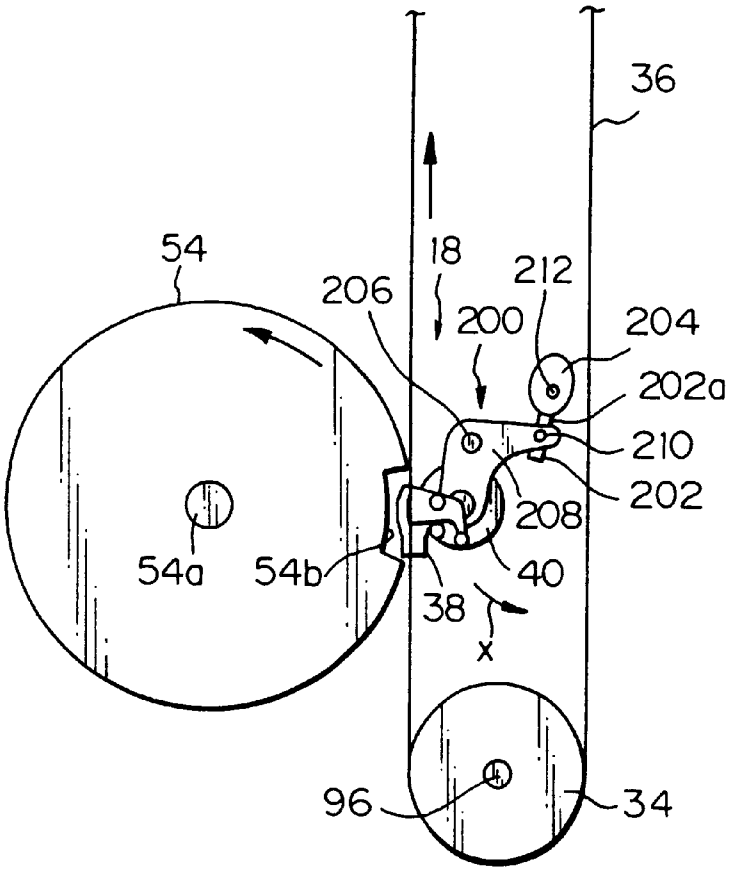
FIG. 21B is a front view showing the image transfer roller retracted.
Figure 21A:
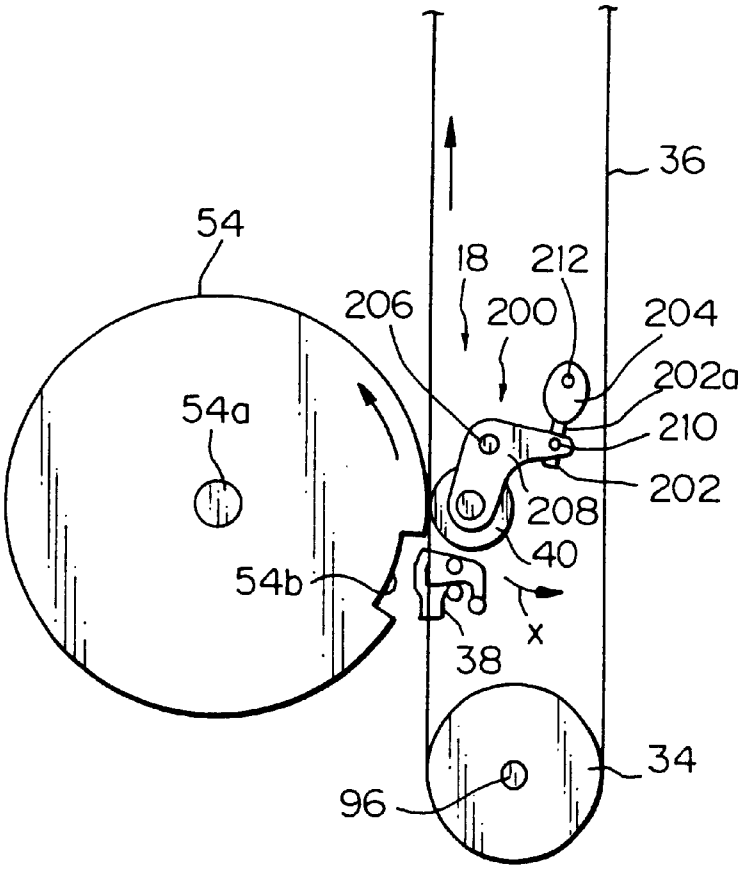
FIG. 21A is a view showing the clamper of the alternative embodiment arrived at an image transfer position.

As shown in FIGS. 21A and 21B, when the clamper 38 arrives at the image transfer position, the drive shaft 212 starts rotating and causes the cam 204 to rotate. As a result, the assembly including the image transfer roller 40 and levers 208 moves in a direction indicated by an arrow X due to its own weight, causing the image transfer roller 40 to retract from the image transfer position. The roller 40 therefore does not interfere with the clamper 38.

Another alternative embodiment of the present invention will be described with reference to FIGS. 22 through 24. The structural elements of the alternative embodiment identical with the structural elements of the previous embodiments are designated by identical reference numerals and will not be described specifically in order to avoid redundancy.

Figure 22:
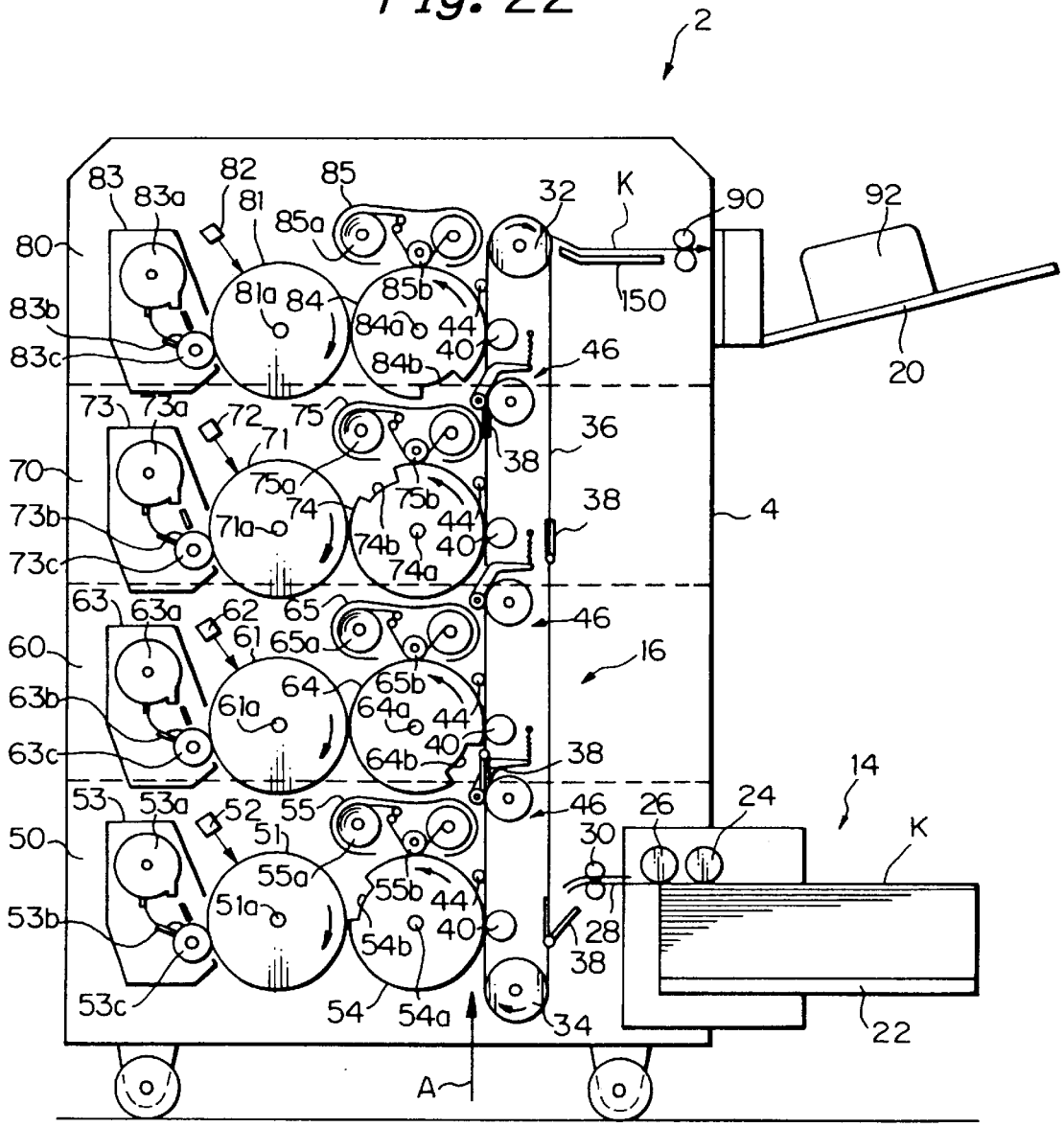
FIG. 22 is a front view showing another alternative embodiment of the present invention.
Figure 23:
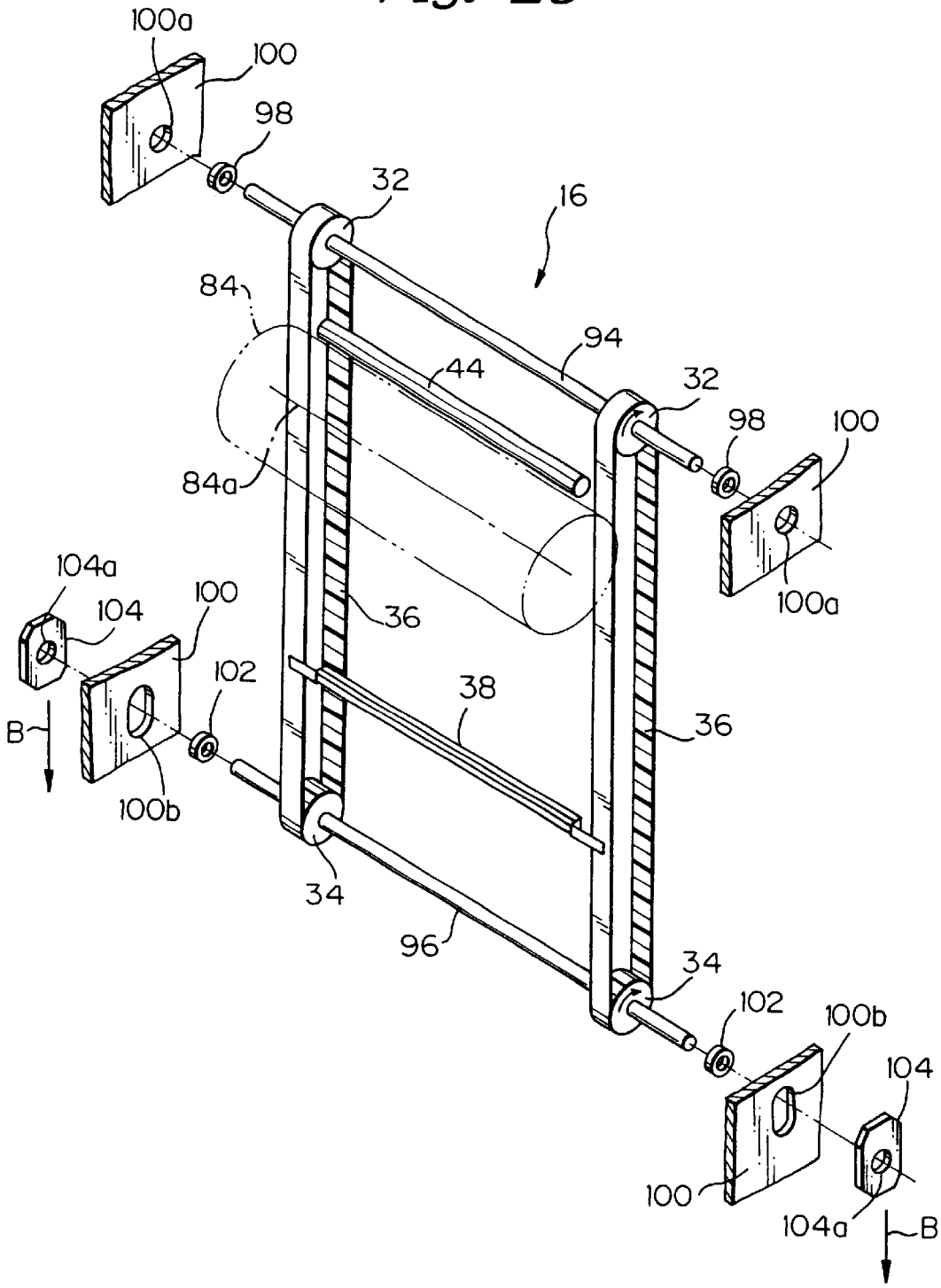
FIG. 23 is an isometric view of a sheet conveying device included in the embodiment of FIG. 22.

As shown in FIG. 22, the image forming sections 50 through 80 each include a pressing roller 44 located downstream of the image transfer position in the direction of sheet conveyance. The pressing roller 44 helps the paper sheet K be separated from associated one of the image transfer drums 54 through 84. More specifically, as shown in FIG. 23, the pressing roller 44 has an axial length small enough to avoid interference with the opposite end portions of the clamper 38 including the cam-operated arms 110. This is also true with the image transfer roller 40.

Figure 24:
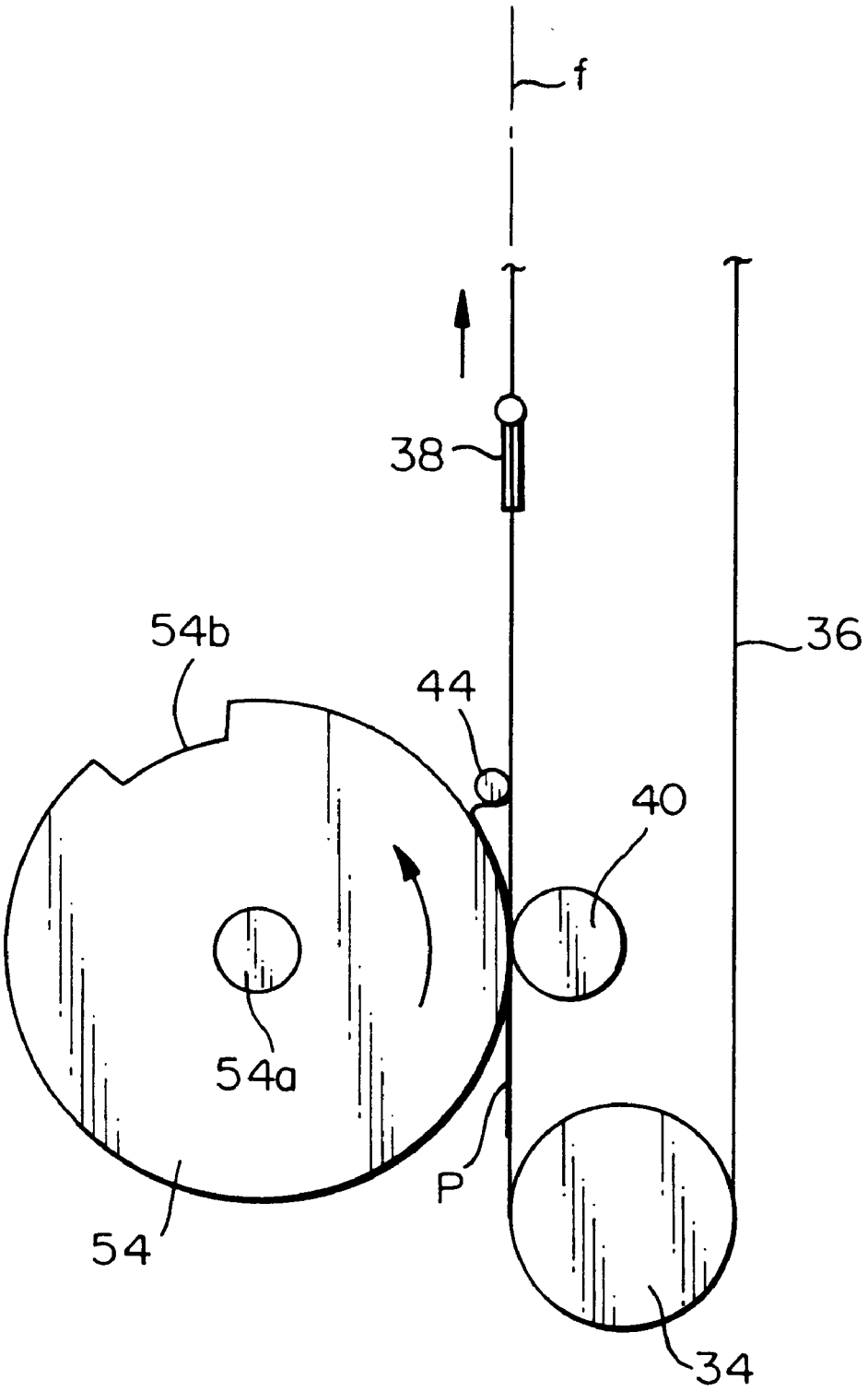
FIG. 24 is a front view shows how a sheet pressing roller included in the embodiment of FIG. 22 separates a paper sheet.

As shown in FIG. 24, the pressing roller 44 has a far smaller diameter than the image transfer drum or image carrier 54 and has a circumference substantially lying in the conveyance plane f. The roller pressing 44 is formed of silicone rubber or similar rubber and water-repellent. In addition, the pressing roller 44 absorbs oils and fats contained in ink.

The paper sheet K, carrying an ink image transferred from the image transfer drum 54, tends to adhere to the drum 54 due to the viscosity of ink and roll up. However, the pressing roller 44 positioned downstream of the image transfer position, i.e., just after the image transfer allows the paper sheet K to be separated from the drum 54 before the initial roll-up occurs. The clamping and conveying force of the clamper 38 is deflected by the roller 44 and substantially entirely contributes to the separation of the paper sheet K from the drum 54. The paper sheet K can therefore be surely separated from the drum 54 despite that the clamping force is weak enough to leave no clamp marks on the paper sheet K. The pressing roller 44 defines a position where the paper sheet K should be separated from the drum 54, obviating irregular density ascribable to irregular separation angle.

The water-repellent pressing roller 44 does not allow ink to deposit thereon despite that it contacts the image surface of the paper sheet K just after the image transfer. This frees the image surface from contamination or blur otherwise occurring due to sequential image transfer. Only the surface layer of the roller 44 may be water-repellent, if desired.

Further, the pressing roller 44 absorbs oils and fats contained in ink to thereby promote rapid fixation of ink. It follows that the paper sheets or prints K sequentially stacked on the tray 20 are free from offset and smearing that is ascribable to rubbing. Only the surface layer of the pressing roller 44 may be formed of a material that absorbs oils and fats, if desired.

Moreover, the diameter of the pressing roller 44 is small enough to prevent the paper sheet K from wrapping around the roller 4 on a curvature separation basis. The pressing roller 44 may be formed of a conductive material, as desired. The conductive roller 44 will discharge the paper sheet K, which may be charged during printing or conveyance, and will thereby prevent the paper sheet K from electrostatically adhering to the roller 44.

Figure 25:
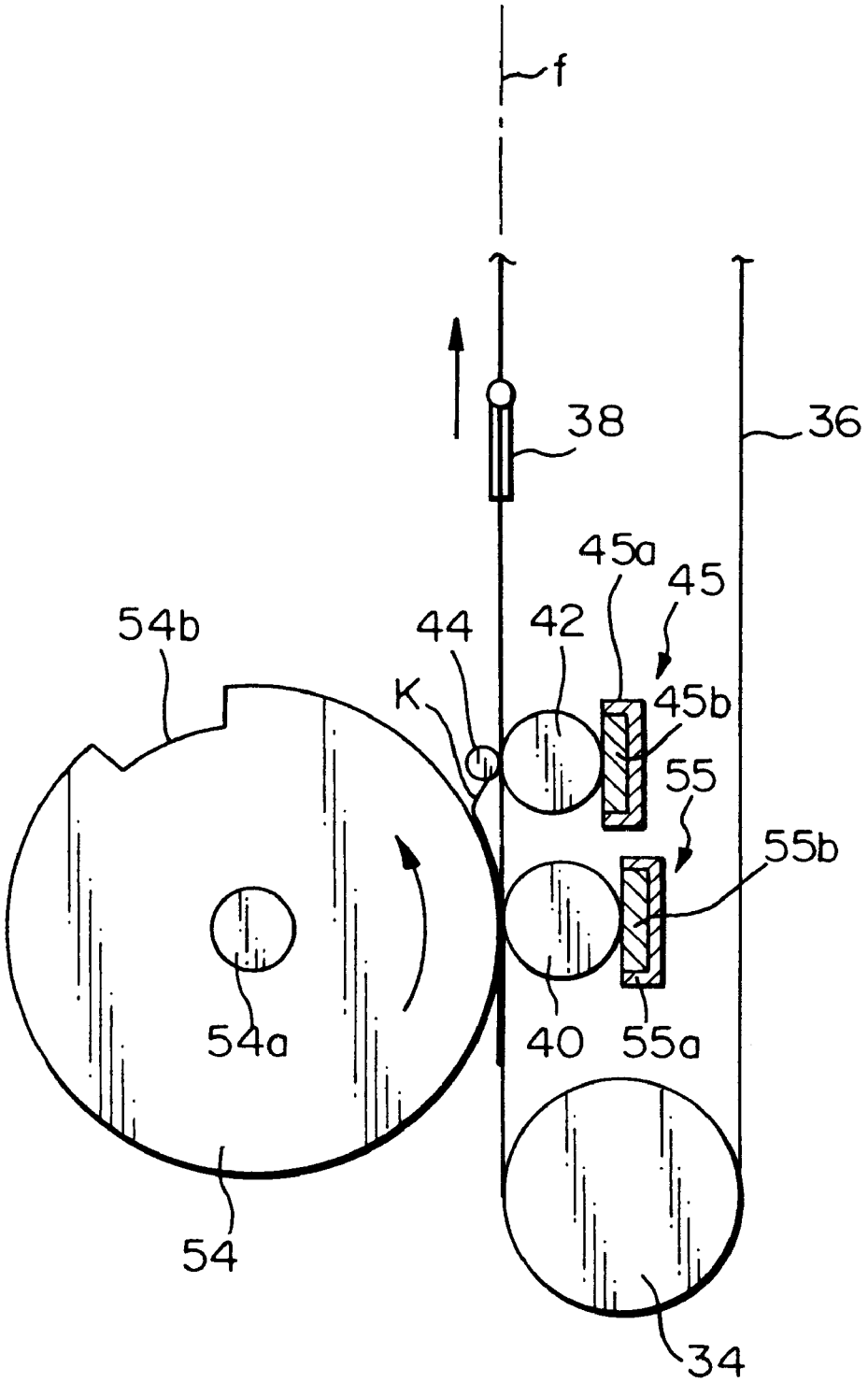
FIG. 25 is a front view showing another alternative embodiment of the present invention.

FIG. 25 shows another alternative embodiment of the present invention. As shown, the illustrative embodiment includes a conveying roller 42 and cleaning device 45 and 55. The conveying roller 42 contacts the rear side or non-image surface of the paper sheet K and conveys the paper sheet K in cooperation with the pressing roller 44. The conveying roller 42, like the pressing roller 44, is formed of silicone rubber and water-repellent. Alternatively, the roller 42 may be formed of a fluorine-containing material. The cleaning devices 45 and 55 respectively clean the surface of the roller 42 and that of the image transfer roller 40.

The cleaning device 45 includes a base 45*a*, a cleaning member 45*b* received in the base 45*a* and implemented by, e.g., felt, and a mechanism, not shown, for pressing the base 45*a* to thereby press the cleaning member 45*b* against the roller 42. The cleaning member 55 is identical in configuration with the cleaning device 45.

The conveying roller 42 conveys the paper sheet K in cooperation with the pressing roller 44. The paper sheet K therefore slips little on the pressing roller 44, compared to the case wherein the pressing roller 44 conveys the paper sheet K alone. The paper sheet K rolls up between the pressing roller 44 and the image transfer drum 54 less than in the configuration of FIG. 24.

The water-repellent conveying roller 42 does not allow unnecessary ink to deposit thereon and therefore frees the paper sheet K from offset. Further, the cleaning device 45 assigned to the conveying roller 42 maintains the roller 42 clean at all times even when a greater number of prints are continuously produced, accurately obviating the offset of paper sheets K.

In the illustrative embodiment, the image transfer roller 40 is formed of a water-repellent silicone-containing material like the conveying roller 42. The image transfer roller 40 therefore prevents unnecessary ink from being transferred thereto from the image transfer drum 54. Moreover, the cleaning device 55 assigned to the image transfer roller 40 maintains the roller 40 clean at all times even when a greater number of prints are continuously produced, accurately obviating the offset of paper sheets K. The rollers 42 and 40 may be formed of a fluorine-containing material, if desired.

The rollers 44 and 42 may be formed of a conductive material, if desired. The conductive rollers 44 and 42 will discharge the paper sheet K, which may be charged during printing or conveyance, and will thereby prevent the paper sheet K from electrostatically adhering to the roller 44.

Figure 26:
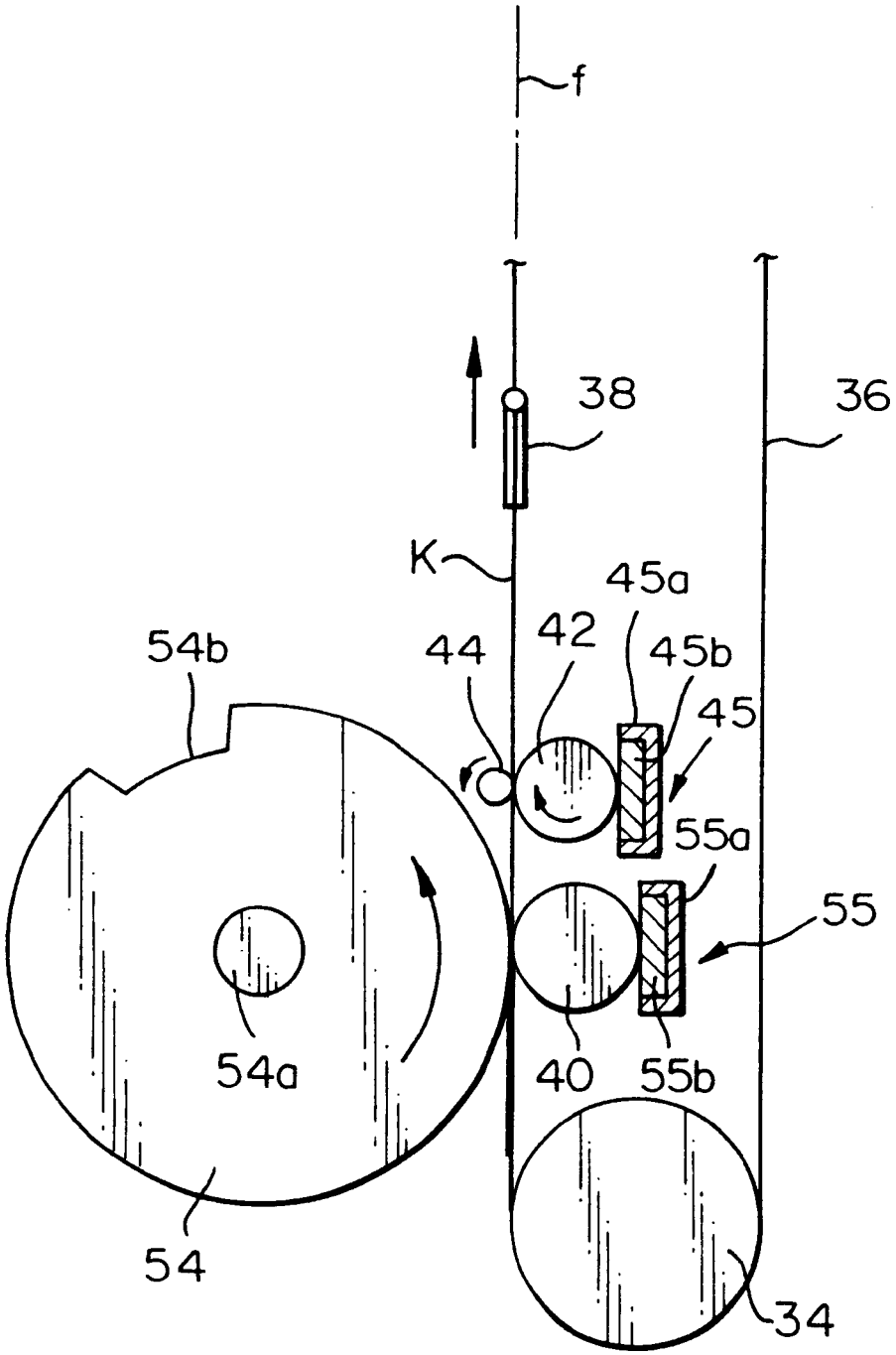
FIG. 26 is a front view showing still another alternative embodiment of the present invention.

FIG. 26 shows another alternative embodiment of the present invention that is similar to the embodiment of FIG. 25 except for the following. As shown, the conveying roller 42 is connected to a drive source, not shown, and caused to rotate thereby at a speed equal to slightly higher than the sheet conveying speed, i.e., the moving speed of the chains 36. The conveying roller 42 in rotation causes the pressing roller 44 to rotate, so that the paper sheet K is conveyed by being nipped by the rollers 42 and 44.

More specifically, just after the image transfer, the paper sheet K is conveyed by the rollers 44 and 42 at a speed equal to or slightly higher than the sheet conveying speed. The paper sheet K can be separated from the image transfer drum 54 before it rolls up between the drum 54 and the roller 44, i.e., before initial roll-up. This minimizes the roll-up of the paper sheet K.

Further, the rollers 44 and 42 separate the paper sheet K from the image transfer drum 54 in cooperation, so that a minimum of clamping force is required of the clamper 38. The clamper 38 can therefore desirably convey the paper sheet K.

Figure 27:
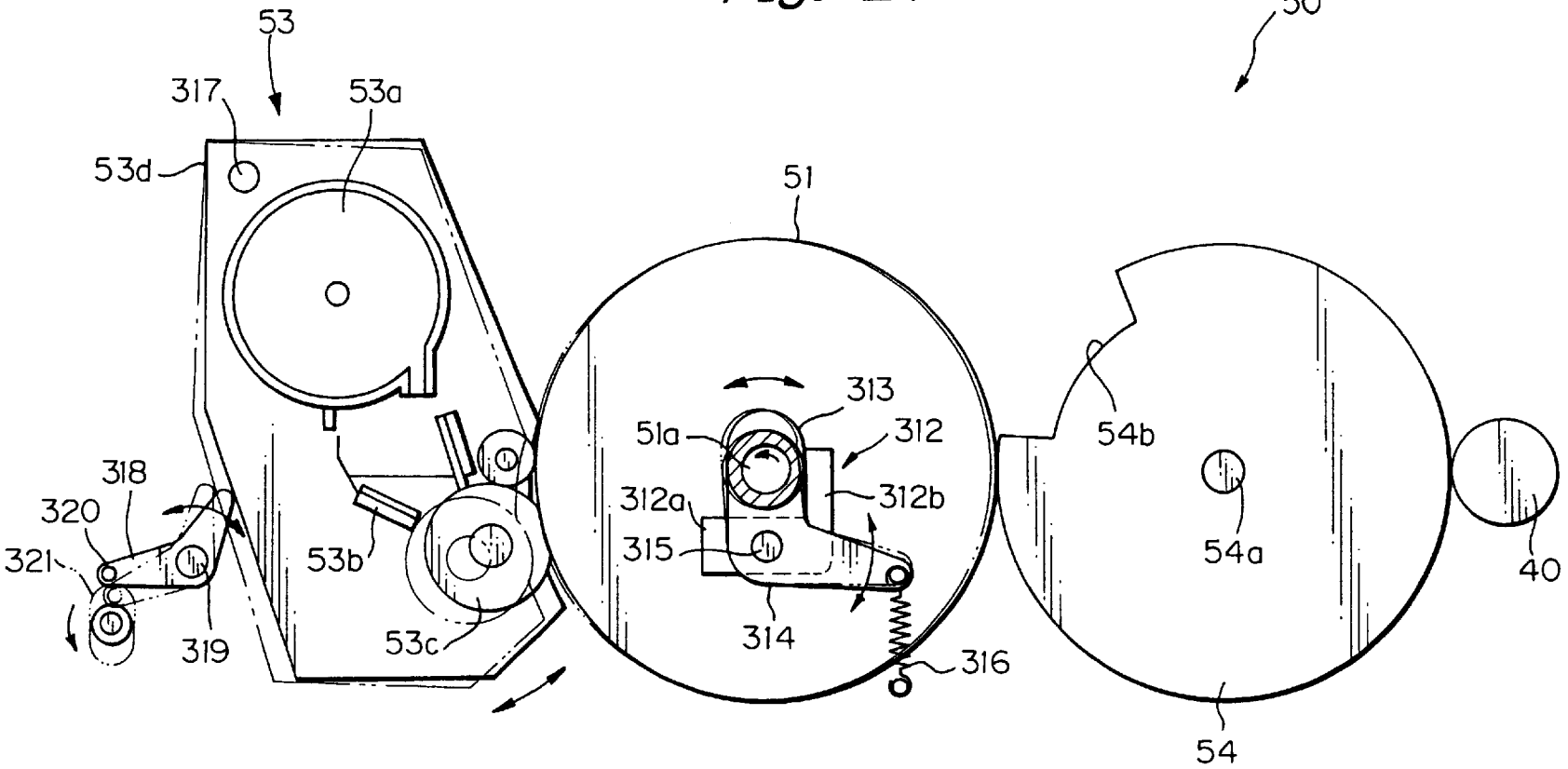
FIG. 27 is a front view showing a yet another alternative embodiment of the present invention.
Figure 28:
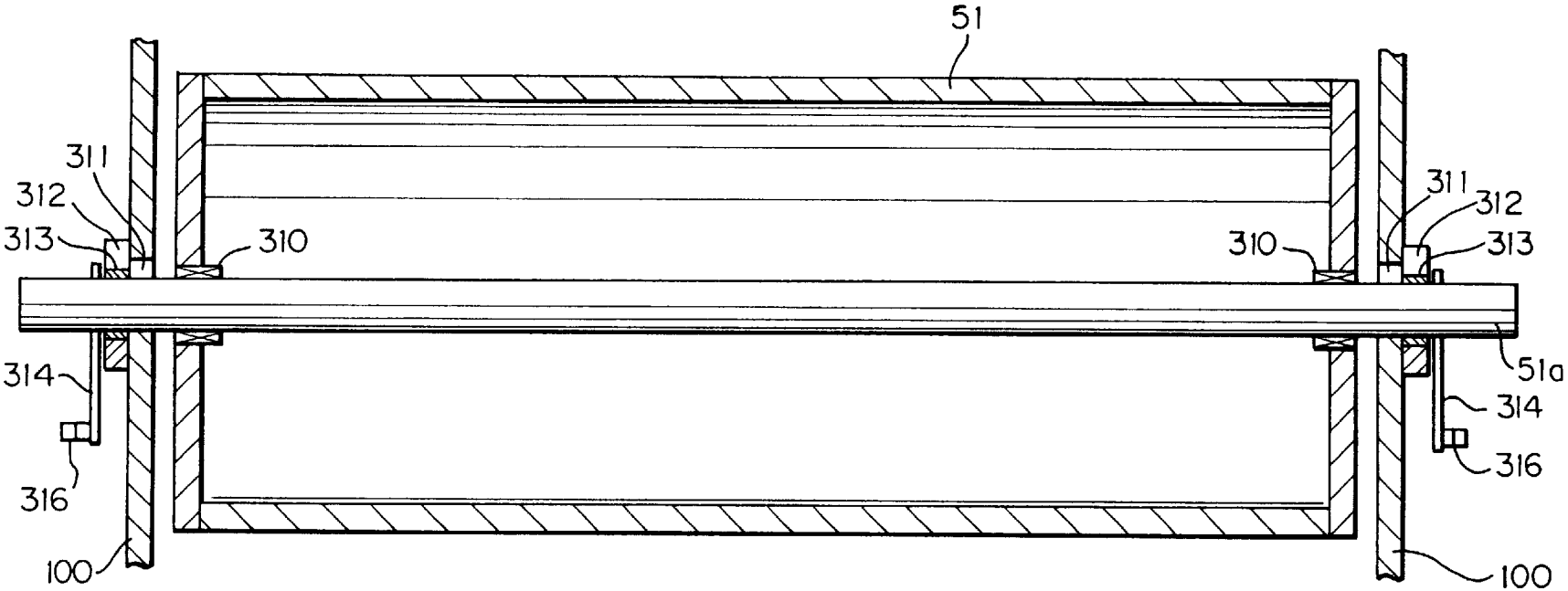
FIG. 28 is a sectional plan view of an image carrier included in the embodiment of FIG. 27.

Reference will be made to FIGS. 27 and 28 for describing still another alternative embodiment of the present invention. The general construction shown in FIG. 16 also applies to this embodiment. As shown, the moving means 18 plays the role of third moving means for moving the image transfer roller or pressing means 40 into and out of contact with associated one of the image transfer drums 54 through 84. The illustrative embodiment includes, in addition to the third moving means, mechanisms each for moving one of the master drums 51 through 81, one of the developing devices 53 through 83 and one of the image transfer drums 54 through 84 into and out of contact with each other. Hereinafter will be described one of such mechanisms assigned to the master drum 51, developing device 53 and image transfer drum 54 by way of example.

The master drum 51 is rotatably mounted on the shaft 51*a* via bearings 310. The shaft 51*a* has its opposite ends passed through slots 311 formed in the opposite side walls 100. The slots 311 extend substantially in the horizontal direction, and each has a width greater than the diameter of the shaft 51*a*. A generally L-shaped bracket 312 is positioned outside of each side wall below each slot 311. The bracket 312 has a substantially horizontal portion 312*a* and a substantially vertical portion 312*b* extending from the end of the horizontal portion 312*a* that is close to the image transfer drum 54.

Cams 313 are respectively mounted on the opposite ends of the shaft 51*a* and supported by the horizontal portions 312*a* of the brackets 312. Further, each end of the shaft 51*a* is supported by one end of a generally L-shaped rotatable member 314. The bent portion of the rotatable member 314 is rotatably supported by a stub 315 protruding from the bracket 312. A tension spring 316 is anchored at one end to the other end of the rotatable member 314 and at the other end to the frame 4. Drive means, not shown, is derivably connected to one end of the shaft 51*a*.

Each tension spring 316 constantly biases the associated cam 313, which rests on the horizontal portion 312*a*, toward the image transfer drum 54 such that the cam 313 contacts the vertical portion 312*b*. The master drum 51 is therefore constantly biased toward the image transfer drum 54. When a smaller diameter portion included in the cam 313 contacts the vertical portion 312*b*, the master drum 51 contacts the image transfer drum 54, as indicated by a solid line in FIG. 27. When the larger diameter portion of the cam 313 contacts the vertical portion 312*b* due to the rotation of the shaft 51*a*, the master drum 51 is released from the image transfer drum 54, as indicated by a dash-and-dots line in FIG. 27.

The image transfer drum 54 is fixed in place. Drive means, not shown, causes the master drum 51 to rotate. The slots 311, brackets 312, cams 313, rotatable members 314, shaft 315 and tension springs 316 constitute second moving means for moving the master drum 51 into and out of contact with the image transfer drum 54.

The developing device 53 is angularly movably supported by a shaft 317 at its top left portion, as viewed in FIG. 27, remote from the master drum 51. A rotatable member 318 is rotatably supported by a shaft 319 supported by the frame 4. One end of the rotatable member 318 contacts one side wall of a casing 53*d* remote from the master drum 51. The other end of the rotatable member 318 rotatably supports a roller 320. An eccentric cam 321 contacts the roller 320 and is caused to rotate by drive means, not shown, mounted on the frame 4.

The center of gravity of the developing device 53 is positioned such that the developing device 53 tends to move away from the master drum 51. When a larger diameter portion included in the eccentric cam 321 contacts the roller 320, it moves the developing device 53 toward the master drum 51, as indicated by a solid line in FIG. 27. When the smaller diameter portion of the eccentric cam 321 contacts the roller 320, it causes the developing device 53 to move away from the master drum 51 due to its own weight, as indicated by a dash-and-dots line in FIG. 27.

The shaft 317, rotatable member 318, shaft 319, roller 320 and eccentric cam 321 constitute third moving means for moving the developing device 53 into and out of contact with the master drum 51. The first and second moving means each are driven at a particular timing.

The operation of the illustrative embodiment will be briefly described hereinafter. When the operator of the printer 2 presses a start switch positioned on an operation panel, not shown, a scanner, not shown, scans a document image and outputs an image signal representative of the document image. The writing device 52 writes an image in the master 300 wrapped around the master drum 51 in accordance with the image data.

In the developing device 53, feeding means, not shown, feeds cyan ink from the ink bottle 53*a* to between the ink blade 53*b* and the developing roller 53*c* in parallel with the image writing operation. At this stage, the first moving means holds the developing roller 53*c* at a position slightly spaced from the master drum 51, so that the roller 53*c* and drum 51 rotate without contacting each other. This is also true with the other image forming sections 60 through 80. The following description will concentrate on the operation of the image forming section 50 by way of example.

When the writing device 52 writes the entire image in the master 300, the first and second moving means are actuated in synchronism with each other. The first moving means presses the developing roller 53*c* against the master drum 51, so that the image formed in the master 300 is developed by the cyan ink. The second moving means presses the master drum 51 against the image transfer drum 54. As a result, an ink image is transferred to the blanket of the image transfer drum 54.

Simultaneously with the image transfer, the sheet feeder 14 causes the pickup roller 24 and separator roller 26 to feed the paper sheets K from the tray 22 one by one. The registration roller pair 30 once stops the paper sheet arrived thereat in order to correct, e.g., screw, as stated earlier. The conveying device 16 is driven such that the chains 36 turn at a preselected linear velocity. The registration roller pair 30 conveys the paper sheet K in synchronism with the opening of the clamper 38. As a result, the open clamper 38 clamps the leading edge of the paper sheet K and conveys it in accordance with the movement of the chains 36.

The third moving means 18 is driven at a preselected timing to bring the image transfer roller 40 against the image transfer drum 54. The image transfer roller 40 presses the paper sheet K against the image transfer drum 54 and thereby transfers the cyan ink image from the drum 54 to the paper sheet K.

Subsequently, the moving means 18 assigned to the other image transfer rollers 40 are sequentially operated to bring the rollers 40 into contact with the associated image transfer drums 64 through 84. Consequently, a magenta ink image, a yellow ink image and a black ink image are sequentially transferred from the image transfer drums 64, 74 and 84 to the paper sheet K over the cyan ink image, completing a multicolor image.

When the clamper 38 releases the paper sheet or print K carrying the multicolor image thereon, the paper sheet K is driven out to the tray 20 via the guide 150. The side fences 92 on the tray 20 position the paper sheet K, as stated earlier.

When a desired number of prints are fully produced, the second moving means releases the master drum 51 from the image transfer drum 54. Subsequently, pressing means, not shown, moves the cleaning roller 55*b* of the cleaning means 55 so as to press the cleaning web 55*a* against the blanket of the image transfer drum 54. The cleaning web 55*a*, paid out and taken up by drive means, not shown, wipes off the ink left on the blanket after the image transfer.

In the illustrative embodiment, the image transfer drums 54 through 84 may be omitted, in which case the ink images will be directly transferred from the master drums 51 through 81 to the paper sheet K. In such a case, the master drums 51 through 81 are fixed in place. Further, the second moving means assigned to the master drums 51 through 81 are omitted. Use are made of moving means for moving the image transfer rollers 40 into and out of contact with the master drums 51 through 81 and the first moving means for moving the developing devices 53 through 83 into and out of contact with the master drums 51 through 81. These moving means each are operated at a particular timing. Writing means for writing an image in the stencil 300 may be implemented by a laser or a thermal head, as desired.

While the stencil 300 has been shown and described as being accommodated in each of the master drums 51 through 81, a stencil may be fed to each of the master drums 51 through 81 from the outside as conventional. Again, use may be made of either one of a laser and the combination of a thermal head and a platen roller for writing an image in the stencil.

Only one of the image forming sections 50 through 80 suffices for a monochromatic printer. Also, five or more image forming sections may be arranged in a printer of the type printing an image with ink of a plurality of different colors.

Figure 29:
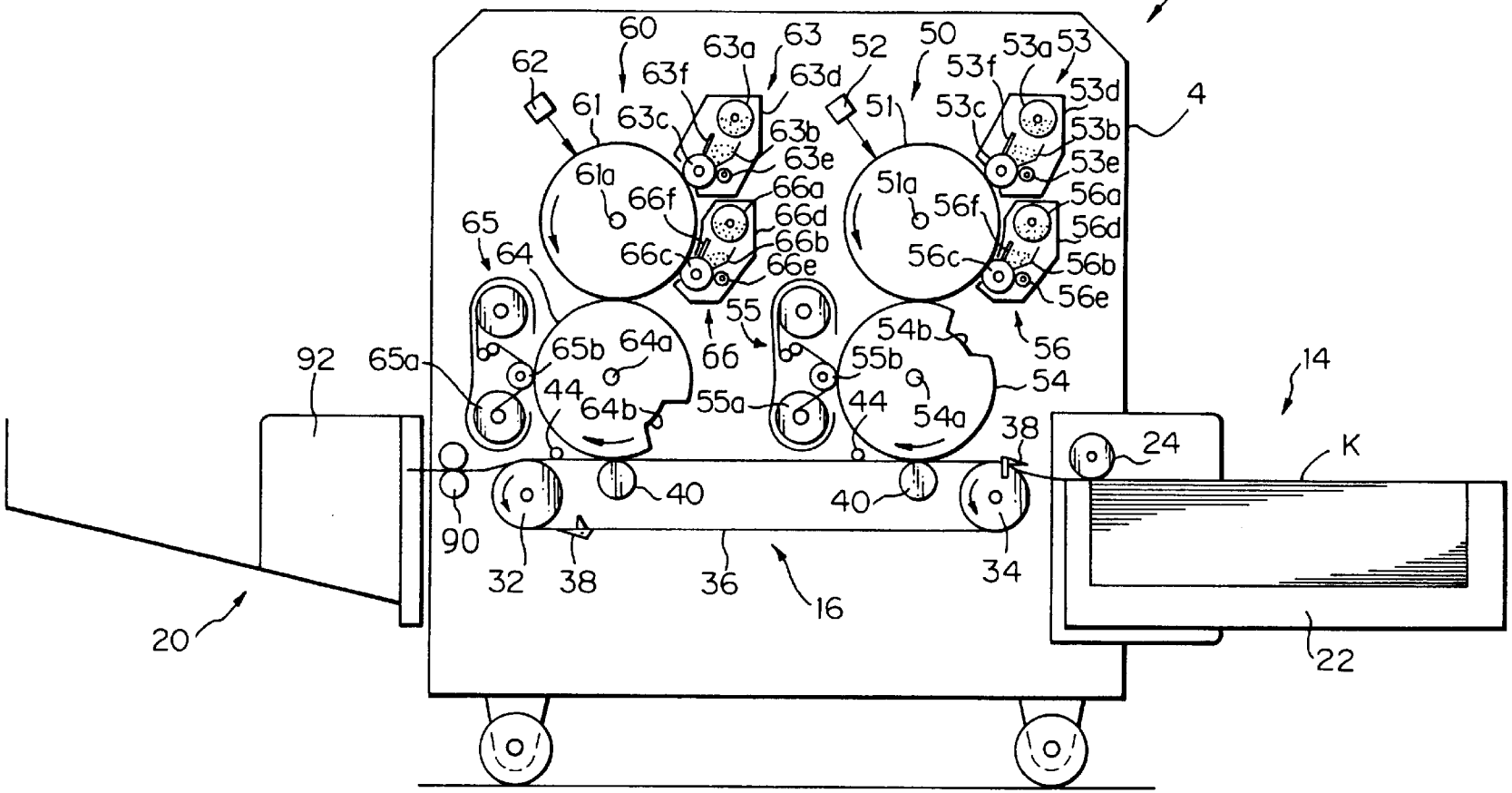
FIG. 29 is a front view showing a further alternative embodiment of the present invention.
Figure 30:
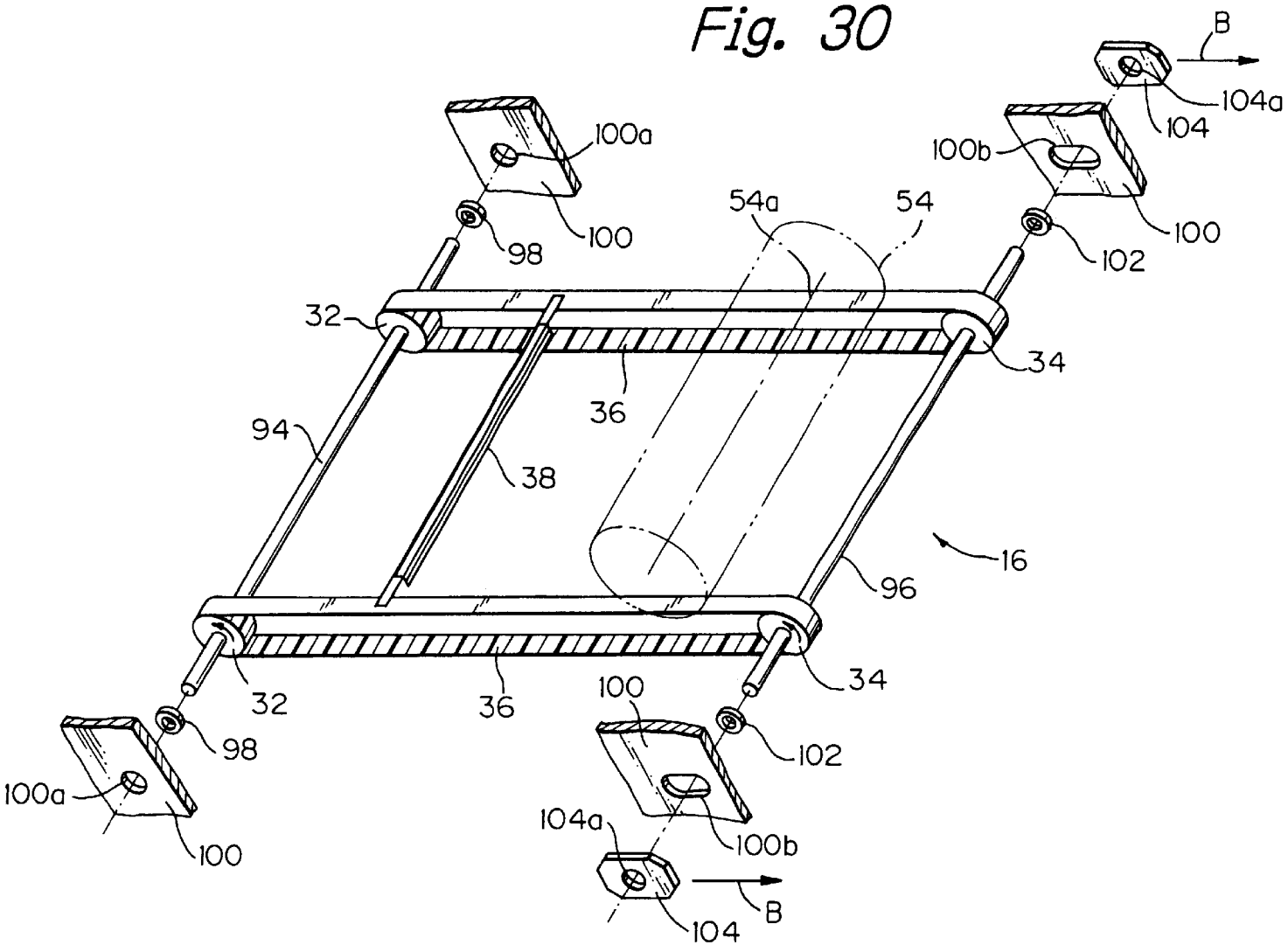
FIG. 30 is an isometric view of a sheet conveying device included in the embodiment of FIG. 29.

FIGS. 29 and 30 show a further alternative embodiment of the present invention. As shown in FIG. 29, an offset printer 8 includes two image forming sections or units 50 and 60 positioned side by side in the horizontal direction. The sheet conveying device 16 is arranged in the horizontal direction below the image forming sections 50 and 60, as also shown in FIG. 30. The image forming section 50 includes the master drum 51 and image transfer drum 54 positioned one above the other. Likewise, the image forming section 60 includes the master drum 61 and image transfer drum 64 arranged one above the other.

In the image forming section 50, two developing devices or ink feeding means 53 and 56 are associated with the master drum 51. The developing device 53 includes a casing 53*d*, a leveling roller 5 for leveling ink on a developing roller 53*c*, and a side wall 53*f* for forming an ink well. The developing device 56 and two developing devices 63 and 66 associated with the other master drum 61 are identical in configuration with the developing device 53 and simply distinguished from the latter by reference numerals.

The developing device 53 included in the image forming section 50 stores cyan (C) ink. An ink bottle 56*a* included in the developing device 56 stores yellow (Y) ink. The ink bottle 63*a* of the image forming section 60 stores magenta (M) ink. An ink bottle 66*a* included in the developing device 66 stores black (Bk) ink. The sheet conveying device 16 includes two clampers 38.

A full-color mode operation unique to the illustrative embodiment will be described hereinafter. When the operator presses a start switch positioned on an operation panel, not shown, a scanner, not shown, scans a document image and outputs an image signal representative of the document image. The writing device 52 writes an image in the stencil 300 wrapped around the master drum 51 in accordance with the image signal.

In the developing device 53, feeding means, not shown, feeds cyan ink from the ink bottle 53*a* to between the ink blade 53*b* and the developing roller 53*c* in parallel with the image writing operation. At this stage, moving means, not shown, holds the developing rollers 53*c* and 56*c* and image transfer drum 54 at position slightly spaced from the master drum 51, so that the roller 53*c* and 56*c* and drum 51 rotate without contacting the drum 51. This is also true with the other image forming section 60. The following description will concentrate on the operation of the image forming section 50 by way of example.

When the writing device 52 writes the entire image in a stencil 300 wrapped around the master drum 51, one moving means is actuated to press the developing roller 53*c* against the master drum 51, so that the image formed in the stencil or master 300 is developed by the cyan ink. The other moving means presses the master drum 51 against the image transfer drum 54. As a result, an ink image is transferred to the blanket of the image transfer drum 54.

At the same time as the image transfer, the sheet feeder 14 causes the pickup roller 24 to feed the paper sheets K from the tray 22 one by one. The clamper 38 clamps the leading edge of the paper sheet K and conveys it. The image transfer roller 40 presses the paper sheet K against the image transfer drum 54 to thereby transfer the cyan ink image to the paper sheet K. Subsequently, the image transfer roller 40 assigned to the image transfer drum 64 presses the paper sheet K carrying the cyan ink image thereon against the drum 64. As a result, a magenta ink image is transferred from the image transfer drum 64 to the paper sheet K over the cyan toner image. The outlet roller pair 90 drives the resulting bicolor print K out of the frame 4 to the tray 20. The side fences 92 position the bicolor print K on the tray 20.

When a desired number of prints are fully produced, the moving means releases the master drum 51 from the image transfer drum 54 and developing devices 53 and 56. Subsequently, pressing means, not shown, moves the cleaning roller 55*b* of the cleaning means 55 so as to press the cleaning web 55*a* against the blanket of the image transfer drum 54. The cleaning web 55*a*, paid out and taken up by drive means, not shown, wipes off the ink left on the blanket after the image transfer.

Subsequently, the operator picks up the paper sheets or bicolor prints K stacked on the tray 20, sets them on the tray 22, and again presses the start switch. In response, the developing devices 56 and 66 operate in the same manner as the developing devices 53 and 63, respectively producing a yellow ink image and a black ink image. The yellow ink image and black ink image are sequentially transferred to each bicolor print K. The resulting full-color prints K are sequentially stacked on the tray 20.

Each of the two image forming sections 50 and 60 may include only one ink feeding device or three or more ink feeding devices, if desired. The crux is that each image forming section includes ink feeding means capable of feeding ink of different colors. Specifically, as for an offset printer including a single image forming section, the image forming section may include four ink feeding means assigned to cyan ink, magenta ink, yellow ink and black ink, respectively. While a full-color image is available even with three ink feeding means assigned to cyan, magenta and yellow, black ink enhances the quality of a full-color image.

When a plurality of image forming sections exist, they should preferably be provided with the same number of ink feeding means. This allows a print to be completed by printing repeated a number of times corresponding to the number of ink feeding means and thereby promotes efficient printing.

In any one of the embodiments shown and described, ink of any desired colors can be used and can be assigned to any desired image forming section. If desired, ink images of different colors may be sequentially formed on an image transfer drum one above the other and then collectively transferred to a paper sheet as conventional. In such a case, a new image will be written in a stencil every time an image is transferred from an image carrier to the image transfer drum. An image may be directly transferred from a master drum to a paper sheet without the intermediary of an image transfer drum, as stated earlier. Anyone of conventional writing means maybe used, e.g., a laser or the combination of a thermal head and a platen roller. Again, the writing means for writing an image in a stencil maybe implemented by a laser or a thermal head, as desired.

In summary, it will be seen that the present invention provides a printer and a sheet conveying device therefor having various unprecedented advantages, as enumerated below.

(1) The printer insures highly accurate images free from irregular registration. This is also true when the printer is implemented as an offset printer.

(2) The period of rotation of an image carrier and the period of movement of a clamper affixed to chains can be accurately synchronized to each other. Images can therefore be accurately protected from positional deviation.

(3) A paper sheet can be conveyed perpendicularly to the axis of rotation of an intermediate image carrier and is therefore free from skew during conveyance.

(4) The clamper affixed to the chains can be provided with a greater width than a paper sheet so as to clamp a paper sheet with a constant clamping ratio without regard to paper size.

(5) Image transfer positions are prevented from shifted due to slackening of the chains.

(6) The clamper can be easily affixed to the chains and easily made parallel to the axis of the image carrier.

(7) The chains are prevented from shaking or vibrating. This insures stable, accurate sheet conveyance.

(8) Noise ascribable to the collision of the clamper against rollers is reduced while the chains are running. In addition, After the clamper has moved away from the rollers, the chains are sharply prevented from shaking.

(9) The paper sheet remains stable around the image transfer position, freeing the resulting image from blur.

(10) A mechanical opening/closing arrangement allows the clamper to surely clamp a paper sheet at a clamping position.

(11) At the clamping position, the clamper is surely opened by a preselected angle relative to a path extending from a paper feeder. The clamper can therefore receive and clamp a paper sheet with stability.

(12) The clamper can smoothly enter and move along guide members with a minimum of noise.

(13) Extra arrangements for supporting the guide members are not necessary, so that a cam mechanism for sheet feed is simplified in construction.

(14) A mechanical arrangement allows the clamper to surely release a paper sheet or print.

(15) A paper sheet is prevented from adhering to the clamper. The paper sheet can therefore be surely driven out of the printer without jamming the path.

(16) The clamper can move without resorting to extra arrangements for causing rollers to retract. The paper sheet can therefore be stably conveyed by a simple, low cost configuration.

(17) The printer is miniature, compact and low cost.

(18) There can be substantially obviated noise ascribable to the collision of the clamper against an image transfer roller and irregularity in the torque of a driveline ascribable to the clamper passing an image transfer position by being held between the image transfer roller and the image carrier. In addition, the clamping force of the clamper does not vary when the clamper passes the image transfer position, preventing a paper sheet from slipping out of the clamper.

(19) Noise and torque variations are minimized when the clamper passes the image transfer position. Further, a jamming paper can be easily dealt with.

(20) The density of an ink image can be easily controlled.

(21) A force pressing the image transfer roller against the image carrier is uniform in the axial direction of the image transfer drum, reducing irregular image transfer.

(22) A paper sheet is prevented from rolling up and can be separated from the image transfer roller at a preselected angle. This also successfully reduces irregular image density.

(23) The clamping force of the clamper can be effectively transformed to a force for separating a paper sheet from the image transfer drum.

(24) A roller for pressing a paper sheet is free from smears ascribable to ink and frees a print from blur ascribable to retransfer.

(25) Ink deposited on a paper sheet can be fixed on a paper sheet in a short period of time.

(26) A paper sheet is prevented from wrapping around the roller, which presses a paper sheet, on a curvature separation basis.

(27) A paper sheet is prevented from electrostatically adhering to the above roller.

(28) A paper sheet and the roller slip little on each other. This further reduces the roll-up of a paper sheet between the roller and the image carrier.

(29) Unnecessary ink, which would bring about offset, is prevented from being transferred from the roller to a paper sheet.

(30) The surface of a conveying roller can be maintained clean at all times, so that offset is surely obviated even when a great number of prints are produced.

(31) Even when a paper sheet is charged, it can be discharged and can therefore be preventing from adhering to the roller, which presses the paper sheet.

(32) Not only the roll-up of a paper sheet is accurately reduced, but also a clamping force required of the clamper is noticeably reduced.

(33) There can be implemented a printer having sheet conveying means arranged at one side of an image forming unit and an image carrier spaced from the other arrangements, i.e., ink feeding means and an image transfer body.

(34) There can be implemented a printer in which an image transfer body and pressing means are brought into contact only when an image is transferred from the image transfer body to a paper sheet. This kind of printer frees the pressing means from smears ascribable to ink.

(35) There can be implemented a printer in which ink feeding means, an image carrier and pressing means are displaceable relative to an image transfer body, which is fixed in place. Such constituents can therefore be desirably controlled in position.

(36) There can be implemented a printer whose body is reduced in size in the up-and-down direction.

(37) There can be implemented a printer having sheet conveying means extending substantially in the vertical direction. The printer is therefore reduced in size in the horizontal direction.

(38) There can be provided a printer not only reduced in size in the horizontal direction, but also capable of printing a full-color image without resorting to an extra area for installation.

(39) There can be provided a printer having a plurality of developing devices arranged around a single image carrier.

(40) There can be implemented a printer capable of easily printing a high quality, full-color image on a paper sheet.

(41) There can be implemented an efficient printer capable of transferring images of different colors to a paper sheet one above the other by using all ink feeding means available.

(42) There can be implemented a miniature printer not needing a space otherwise allocated to a stencil or image carrying member outside of an image carrier.

(43) There can be implemented a compact printer not needing an arrangement for feeding wetting water.

Various modifications will become possible for those skilled in the art after receiving the teachings of the present disclosure without departing from the scope thereof.

What is claimed is:

1. A printer comprising:

at least one image carrier; and a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region, wherein said chain is passed over a pair of toothed pulleys and has a circumferential pitch length that is an integral multiple of a circumferential length of said image carrier, and a number of teeth that is an integral multiple of a number of teeth of one of said pair of pulleys.

2. The printer as claimed in claim 1, wherein said image carrier comprises an intermediate image transfer body.

3. The printer as claimed in claim 1, wherein said chain comprises a pair of chains spaced from each other in an axial direction of said image carrier and each being passed over a respective pair of toothed pulleys, said pair of chains extend substantially perpendicularly to an axis of said image carrier and run substantially in parallel to each other, and said clamper is affixed at opposite ends thereof to said pair of chains substantially in parallel to the axis of said image carrier.

4. The printer as claimed in claim 3, wherein a space between said pair of chains is greater than a maximum sheet size available with said printer in a direction perpendicular to the direction of sheet conveyance.

5. The printer as claimed in claim 3, wherein pairs of toothed pulleys over which said pair of chains are respectively passed are fixed in place with teeth thereof aligning with each other in the axial direction of said image carrier.

6. The printer as claimed in claim 1, wherein a driving one of said pair of pulleys is positioned at a downstream side of said image transfer region, and a tense run of said chain is closer to said image carrier than the other run.

7. The printer as claimed in claim 1, wherein a driven one of said pair of toothed pulleys is configured to adjust tension acting on said chain.

8. The printer as claimed in claim 1, further comprising a stabilizing mechanism positioned in said image transfer region for maintaining a position of said chain relative to said image carrier.

9. The printer as claimed in claim 1, wherein said image carrier accommodates therein an image carrying member part of which is selectively wrapped around said image carrier, an image being formed in part of said image carrying member wrapped around said image carrier.

10. The printer as claimed in claim 9, wherein said image carrying member comprises a thermosensitive, water-repellent printing plate.

11. A printer comprising:

at least one image carrier; and a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance;

a clamper affixed to said chain for clamping the sheet fed at a sheet feed position, which is located at an upstream side of said image transfer region; and a stabilizing mechanism positioned in said image transfer region for maintaining a position of said chain relative to said image carrier, wherein said stabilizing mechanism comprises:

an idler pulley for maintaining the position of said chain relative to said image carrier; and a pressing roller facing said idler pulley for nipping said chain between said pressing roller and said idler pulley.

12. The printer as claimed in claim 11, wherein said pressing roller is resiliently held in contact with said chain and retractable, when said clamper passes said pressing roller, on contacting said clamper.

13. A printer comprising:

at least one image carrier; and a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region;

wherein said clamper is affixed to said chain such that said clamper, clamping the sheet, conveys said sheet in a direction substantially tangential to said image carrier, and wherein said clamper is configured to ease collision of said clamper against rollers arranged on a conveyance path of said chain and to cause said rollers to retract.

14. The printer as claimed in claim 13, wherein said image carrier comprises an intermediate image transfer body.

15. The printer as claimed in claim 13, wherein said clamper is constantly biased to remain closed, said printer further comprising cam means for sheet feed for causing, on contacting said clamper, said clamper to open and then close at the sheet feed position.

16. The printer as claimed in claim 15, wherein said cam means for sheet feed comprises:

a cam for causing said clamper to open and then close; and a guide member for preventing said chain from shaking when said clamper opens and closes.

17. The printer as claimed in claim 17, wherein said clamper includes at least two contact portions spaced from said guide member in the direction of sheet conveyance.

18. The printer as claimed in claim 17, wherein said two contact portions comprise cam followers.

19. The printer as claimed in claim 16, wherein said cam and said guide member are formed integrally with each other.

20. The printer as claimed in claim 13, further comprising cam means for sheet discharge for causing said clamper to open and then close on contacting said clamper at a preselected position.

21. The printer as claimed in claim 13, wherein said image carrier accommodates therein an image carrying member part of which is wrapped around said image carrier, an image being formed in part of said image carrying member wrapped around said image carrier.

22. The printer as claimed in claim 21, wherein said image carrier comprises a thermosensitive, water-repellent printing plate.

23. A printer comprising:

at least one image carrier; and a sheet conveying device for conveying a sheet to which an image is to be transferred form said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region;

wherein said clamper is affixed to said chain such that said clamper, clamping the sheet, conveys said sheet in a direction substantially tangential to said image carrier, wherein said clamper is constantly biased to remain closed, said printer further comprising cam means for sheet feed for causing, on contacting said clamper, said clamper to open and then close at the sheet feed position, wherein said cam means for sheet feed comprises:

a cam for causing said clamper to open and then close; and a guide member for preventing said chain from shaking when said clamper opens and closes, wherein said clamper includes at least two contact portions spaced from said guide member in the direction of sheet conveyance, and wherein said guide member has such a length that said two contact portions contact said guide member before said clamper opens, and continuously contact said guide member until said clamper closes.

24. A printer comprising:

at least one image carrier;

a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region; and cam means for sheet discharge for causing said clamper to open and then close on contacting said clamper at a preselected position wherein said clamper is affixed to said chain such that said clamper, clamping the sheet, conveys said sheet in a direction substantially tangential to said image carrier, and wherein said cam means for sheet discharge comprises a forcing mechanism for forcing the sheet outward of said chain in accordance with an opening motion of said clamper.

25. The printer as claimed in claim 24, wherein said forcing mechanism comprises:

a base member;

a lever rotatably supported by said base member and continuously contacting said clamper until said clamper releases the sheet; and a biasing member for causing said lever to elastically restore when said lever moves away from said clamper.

26. A sheet conveying device comprising:

a chain driven to turn;

a clamper affixed to said chain and biased to maintain a closed position for clamping a sheet; and cam means for sheet feed for causing said clamper to open, clamp the sheet, and then close;

wherein said cam means for sheet feed comprises:

a cam for causing said clamper to open and then close; and a guide member for preventing said chain from shaking when said clamper opens and closes, wherein said clamper includes at least two contact portions spaced from said guide member in a direction of sheet conveyance, and wherein said guide member has such a length that said two contact portions contact said guide member before said clamper opens, and continuously contact said guide member until said clamper closes.

27. The device as claimed in claim 26, wherein said clamper includes at least two contact portions spaced from said guide member in a direction of sheet conveyance.

28. The device as claimed in claim 27, wherein said two contact portions comprise cam followers.

29. The device as claimed in claim 26, further comprising cam means for sheet discharge for causing said clamper to open and then close on contacting said clamper at a preselected position.

30. A sheet conveying device comprising:

a chain driven to turn;

a clamper affixed to said chain and constantly biased to maintain a closed position for clamping a sheet; and cam means for sheet feed for causing said clamper to open, clamp the sheet, and then close;

wherein said cam means for sheet feed comprises:

a cam for causing said clamper to open and then close; and a guide member for preventing said chain from shaking where said clamper opens and closes, wherein said cam and said guide member are formed integrally with each other.

31. A sheet conveying device comprising:

a chain driven to turn;

a clamper affixed to said chain and biased to maintain a closed position for clamping a sheet;

cam means for sheet feed for causing said clamper to open, clamp the sheet, and then close;

wherein said cam means for sheet feed comprises:

a cam for causing said clamper to open and then close; and a guide member for preventing said chain from shaking when said clamper opens and closes; and cam means for sheet discharge for causing said clamper to open and then close on contacting said clamper at a preselected position, wherein said cam means for sheet discharge comprises a forcing mechanism for forcing the sheet outward of said chain in accordance with an opening motion of said clamper.

32. The device as claimed in claim 31, wherein said forcing mechanism comprises:

a base member;

a lever rotatably supported by said base member and continuously contacting said clamper until said clamper releases the sheet; and a biasing member for causing said lever to elastically restore when said lever moves away from said clamper.

33. A printer comprising:

at least one image carrier; and a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance;

a clamper affixed to said chain for clamping the sheet fed at a sheet feed position, which is located at an upstream side of said image transfer region; and an image transfer roller for pressing the sheet against said image carrier;

wherein said image transfer roller is smaller in diameter than said image carrier.

34. The printer as claimed in claim 33, wherein said image carrier comprises an intermediate image transfer body.

35. The printer as claimed in claim 33, wherein said chain comprises a pair of chains each being passed over a respective pair of toothed pulleys in a form of an elongate loop;

said pair of chains each have opposite runs substantially uniformly spaced from each other in the direction of sheet conveyance; and said image transfer roller has a smaller diameter than one of said pair of toothed pulleys.

36. The printer as claimed in claim 33, wherein said clamper includes a portion, which clamps the sheet, generally protruding toward said image carrier over a sheet conveyance plane, and said image carrier is formed with a recess configured to receive said portion of said clamper when said clamper passes said image carrier.

37. The printer as claimed in claim 33, further comprising moving means for selectively moving said image transfer roller into or out of contact with said image carrier to thereby avoid or ease contact of said image transfer roller with said clamper when said clamper passes said image transfer roller.

38. The printer as claimed in claim 37, wherein said moving means exerts an adjustable pressure on said image carrier.

39. The printer as claimed in claim 38, wherein said moving means comprises:

a support member rotatably mounted on a body of said printer and supporting said image transfer roller at one end thereof;

a screw held in threaded engagement with the other end of said support member; and a cam contacting said screw;

wherein said screw is adjustable in order to adjust the pressure.

40. The printer as claimed in claim 37, wherein said moving means has a play configuration for pressing said image transfer roller uniformly against said image carrier in an axial direction of said image transfer roller.

41. The printer as claimed in claim 38, wherein said image carrier accommodates therein an image carrying member part of which is wrapped around said image carrier, an image being formed in part of said image carrying member wrapped around said image carrier.

42. The printer as claimed in claim 41, wherein said image carrier comprises a thermosensitive. water-repellent printing plate.

43. A printer comprising:

at least one image carrier; and a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance;

a clamper affixed to said chain for clamping the sheet fed at a sheet feed position, which is located at an upstream side of said image transfer region; and a pressing roller positioned downstream, in the direction of sheet conveyance, of a position at which an image formed on said image carrier is to be transferred, for helping the sheet to be separated from said image carrier after image transfer.

44. The printer as claimed in claim 43, wherein said image carrier comprises an intermediate image transfer body.

45. The printer as claimed in claim 43, wherein said pressing roller has a circumference substantially lying in a sheet conveyance plane.

46. The printer as claimed in claim 43, wherein at least a surface layer of said pressing roller is water-repellent.

47. The printer as claimed in claim 46, wherein at least a surface of said pressing roller absorbs fats and oils contained in ink.

48. The printer as claimed in claim 43, wherein said pressing roller is smaller in diameter than said image carrier.

49. The printer as claimed in claim 43, wherein said pressing roller is electrically conductive.

50. The printer as claimed in claim 43, further comprising a conveying roller nipping the sheet in cooperation with said pressing roller in contact with a non-image surface of said sheet.

51. The printer as claimed in claim 50, wherein at least a surface of said conveying roller is water-repellent.

52. The printer as claimed in claim 50, wherein at least a surface layer of said conveying roller is formed of a fluorine- or a silicone-containing material, said printer further comprising cleaning means for cleaning a surface of said conveying roller.

53. The printer as claimed in claim 50, wherein said pressing roller and said conveying roller are electrically conductive.

54. The printer as claimed in claim 50, wherein at least one of said pressing roller and said conveying roller rotates at a speed equal to or slightly higher than a sheet conveying speed.

55. The printer as claimed in claim 43, wherein said image carrier accommodates therein an image carrying member part of which is wrapped around said image carrier, an image being formed in part of said image carrying member wrapped around said image carrier.

56. The printer as claimed in claim 55, wherein said image carrier comprises a thermosensitive, water-repellent printing plate.

57. A printer comprising:

at least one image carrier;

a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region;

ink feeding means for feeding ink to said image carrier;

an intermediate image transfer body facing said image carrier and to which an image is transferred from said image carrier, wherein said intermediate image transfer body constitutes an image forming unit together with said image carrier and said ink feeding means with said sheet conveying device adjoining one side of said image forming unit;

pressing means facing said intermediate image transfer body;

first moving means for selectively bringing said image carrier and said ink feeding means into or out of contact with each other; and second moving means for selectively bringing said image carrier and said intermediate image transfer body into or out of contact with each other.

58. The printer as claimed in claim 57, further comprising third moving means for selectively bringing said intermediate image transfer body and said pressing means into or out of contact with each other.

59. The printer as claimed in claim 57, wherein said intermediate image transfer body is fixed in place.

60. The printer as claimed in claim 57, wherein said image carrier, said ink feeding means and said intermediate image transfer body are positioned substantially horizontally.

61. The printer as claimed in claim 57, wherein said sheet conveying device extends substantially vertically.

62. The printer as claimed in claim 61, wherein said image forming unit comprises a plurality of image forming units arranged one above the other and each forming images of different colors.

63. The printer as claimed in claim 57, wherein said image forming unit comprises a plurality of image forming units arranged one above the other and each forming images of different colors.

64. The printer as claimed in claim 57, wherein said image carrier accommodates therein an image carrying member part of which is wrapped around said image carrier, an image being formed in part of said image carrying member wrapped around said image carrier.

65. The printer as claimed in claim 64, wherein said image carrier comprises a thermosentitive, water-repellent printing plate.

66. A printer comprising:

at least one image carrier;

a sheet conveying device for conveying a sheet to which an image is to be transferred from said image carrier;

said sheet conveying device comprising:

a chain driven to run through an image transfer region, which is positioned immediately adjacent said image carrier, from an up stream side to a downstream side in a direction of sheet conveyance; and a clamper affixed to said chain for clamping the sheet fed at a sheet feed position, which is located at an upstream side of said image transfer region;

ink feeding means for feeding ink to said image carrier, wherein said ink feeding means constitutes an image forming unit together with said image carrier with said sheet conveying device adjoining one side of said image forming unit;

pressing means facing said image carrier;

first moving means for selectively bringing said image carrier and said ink feeding means into or out of contact with each other; and second moving means for selectively bringing said image carrier and said pressing means into or out of contact with each other.

67. The printer as claimed in claim 66, wherein said image carrier is fixed in place.

68. The printer as claimed in claim 66, wherein said image carrier and said ink feeding means are positioned substantially horizontally.

69. The printer as claimed in claim 66, wherein said sheet conveying device extends substantially vertically.

70. The printer as claimed in claim 69, wherein said image forming unit comprises a plurality of image forming units arranged one above the other and each forming images of different colors.

71. The printer as claimed in claim 66, wherein said image forming unit comprises a plurality of image forming units arranged one above the other and each forming images of different colors.

72. The printer as claimed in claim 66, wherein said image carrier accommodates therein an image carrying member part of which is wrapped around said image carrier, an image being formed in part of said image carrying member wrapped around said image carrier.

73. The printer as claimed in claim 72, wherein said image carrier comprises a thermosensitive, water-repellent printing plate.

74. A printer comprising:

at least one image carner;

a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region;

an intermediate image transfer body facing said image carrier and to which an image is transferred from said image carrier, wherein said intermediate image transfer body constitutes an image forming unit together with said image carrier; and pressing means facing said intermediate image transfer body;

wherein said image forming unit comprises a plurality of ink feeding means each for feeding ink of a articular color to said image carrier.

75. The printer as claimed in claim 74, wherein said image forming unit comprises four ink feeding means.

76. The printer as claimed in claim 74, wherein said image forming unit comprises a plurality of image forming units.

77. The printer as claimed in claim 76, wherein said plurality of image forming units have a same number of ink feeding means.

78. The printer as claimed in claim 76, wherein said image forming unit comprises two image forming units each having two ink feeding means, all image forming units each feeding ink of a particular color to a particular image carrier.

79. The printer as claimed in claim 74, wherein said image carrier accommodates therein an image carrying member part of which is wrapped around said image carrier, an image being formed in part of said image carrying member wrapped around said image carrier.

80. The printer as claimed in claim 79, wherein said image carrier comprises a thermosensitive, water-repellent printing plate.

81. A printer comprising:

at least one image carrier;

a sheet conveying device for conveying a sheet to which an image is to be transferred from said image carrier;

said sheet conveying device comprising:

a chain driven to run through an image transfer region, which is positioned immediately adjacent said image carrier, from an upstream side to a downstream side in a direction of sheet conveyance; and a clamper affixed to said chain for clamping the sheet fed at a sheet feed position, which is located at an upstream side of said image transfer region;

pressing means facing said image carrier;

wherein an image forming unit including said image carrier comprise a plurality of ink feeding means each for feeding ink of a particular color to said image carrier.

82. The printer as claimed in claim 81, wherein said image forming unit comprises four ink feeding means.

83. The printer as claimed in claim 81, wherein said image forming unit comprises a plurality of image forming units.

84. The printer as claimed in claim 83, wherein said plurality of image forming units have a same number of ink feeding means.

85. The printer as claimed in claim 83, wherein said image forming unit comprises two image forming units each having two ink feeding means, all image forming units each feeding ink of a particular color to a particular image carrier.

86. The printer as claimed in claim 81, wherein said image carrier accommodates therein an image carrying member part of which is wrapped around said image carrier, an image being formed in part of said image carrying member wrapped around said image carrier.

87. The printer as claimed in claim 86, wherein said image carrier comprises a thermosensitive, water-repellent printing plate.

* * * * *

UNITED STATES PATENT AND TRADEMARK OFFICE

CERTIFICATE OF CORRECTION

PATENT NO. : 6,644,187 B2
DATED : November 11, 2003
INVENTOR(S) : Toyoo Okamoto et al.

It is certified that error appears in the above-identified patent and that said Letters Patent is hereby corrected as shown below:

Column 1,
Line 18, change “coveys” to -- conveys --.
Line 40, change “positions” to -- position; --.

Column 4,
Line 7, change “sowing” to -- showing --.
Line 65, change “shows” to -- showing --.

Column 11,
Line 34, change “chains 38” to -- chains 36 --.
Line 45, change “papersheet 36” to -- paper sheet K --.
Line 62, change “Karrives” to -- K arrives --.

Column 12,
Line 10, change “maybe” to -- may be --.

Column 13,
Line 11, change “, is free” to -- , it is free --.

Column 27,
Line 3, change “38”, to -- 33 --.

Column 29,
Line 58, change “articular” to -- particular --.

Signed and Sealed this

Thirty-first Day of August, 2004

JON W. DUDAS
*Director of the United States Patent and Trademark Office*